United States Patent [19]

Donomoto et al.

[11] Patent Number: 4,492,265

[45] Date of Patent: Jan. 8, 1985

[54] METHOD FOR PRODUCTION OF COMPOSITE MATERIAL USING PREHEATING OF REINFORCING MATERIAL

[75] Inventors: Tadashi Donomoto; Atsuo Tanaka, both of Toyota, Japan

[73] Assignee: Toyota Jidosha Kabushiki Kaisha, Toyota, Japan

[21] Appl. No.: 288,004

[22] Filed: Jul. 29, 1981

[30] Foreign Application Priority Data

| | | | |
|---|---|---|---|
| Aug. 4, 1980 | [JP] | Japan | 55-107040 |
| Mar. 6, 1981 | [JP] | Japan | 56-32289 |
| Mar. 26, 1981 | [JP] | Japan | 56-44847 |
| Mar. 26, 1981 | [JP] | Japan | 56-44848 |
| Mar. 26, 1981 | [JP] | Japan | 56-44849 |

[51] Int. Cl.[3] ..... B22D 19/14; B22D 18/02

[52] U.S. Cl. ..... 164/493; 164/97; 164/103; 164/108; 164/120

[58] Field of Search ..... 164/97, 120, 103, 105, 164/513, 108, 112, 493

[56] References Cited

U.S. PATENT DOCUMENTS

| | | | |
|---|---|---|---|
| 2,482,841 | 9/1949 | Cooper | 164/108 X |
| 3,364,976 | 1/1968 | Reding et al. | 164/98 |
| 3,547,180 | 12/1970 | Cochran et al. | 164/105 X |
| 3,853,635 | 12/1974 | Demendi | 164/97 X |
| 3,903,951 | 9/1975 | Kaneko et al. | 164/97 |
| 3,913,657 | 10/1975 | Banker et al. | 164/105 X |
| 3,949,804 | 4/1976 | Kaneko et al. | 164/120 X |
| 3,970,136 | 7/1976 | Cannell et al. | 164/112 X |
| 4,318,438 | 3/1982 | Ban et al. | 164/120 X |

FOREIGN PATENT DOCUMENTS

| | | | |
|---|---|---|---|
| 39229 | 11/1971 | Japan | 164/63 |

*Primary Examiner*—Gene P. Crosby
*Assistant Examiner*—Marc Hodak
*Attorney, Agent, or Firm*—Stevens, Davis, Miller & Mosher

[57] ABSTRACT

A method of producing a composite material from porous reinforcing material and molten matrix metal. First the porous reinforcing material is heated up to a temperature substantially above melting point of the matrix metal. Then the molten matrix metal is infiltrated into the porous structure of the reinforcing material under a substantial pressure. Then the combination of the reinforcing material and the matrix metal infiltrated thereinto is cooled down to a temperature below the melting point of the matrix metal, while maintaining the above-mentioned substantial pressure. Optionally, the reinforcing material may be charged into a case; and, again optionally, the case may have one opening only, and a vacant space may be left between another part of the case and the reinforcing material charged in the case, with the reinforcing material interrupting communication between the opening and the vacant space. The case can be made of stainless steel, or of a refractory material such as porous brick. Possible materials for the reinforcing material include fibers of alumina, carbon, boron, or stainless steel; and possible materials for the matrix metal include aluminum and magnesium.

3 Claims, 22 Drawing Figures

100μ

100μ

(x70)

(x70)

(x0.7)

(x0.7)

METHOD FOR PRODUCTION OF COMPOSITE MATERIAL USING PREHEATING OF REINFORCING MATERIAL

BACKGROUND OF THE INVENTION

The present invention relates to a method for producing composite material, and, more particularly, relates to a method for producing composite material composed of a reinforcing material such as fiber, wire, powder, whiskers, or the like embedded within a matrix of metal.

There are known various types of reinforced materials, in which powder, whiskers, or fibers of a reinforcing material such as metal (stainless steel, for example), alumina, boron, carbon, or the like are embedded within a matrix of metal such as aluminum or magnesium or the like to form a composite material, and various methods of production for such composite or reinforced material have already been proposed.

One such known method for producing such fiber reinforced material is called the diffusion adhesion method, or the hot press method. In this method, a number of sheets are made of fiber and matrix metal by spraying molten matrix metal onto sheets or mats of fiber in a vacuum; and then these sheets are overlaid together, again in a vacuum, and are pressed together at high temperature so that they stick together by the matrix metal diffusing between them. This method has the disadvantage of requiring complicated manipulations to be undertaken in the inside of a vacuum device of a large size. This is clumsy, difficult, and expensive, and accordingly this diffusion adhesion method is unsuitable for mass production, due to high production cost and production time involved therein.

Another known method for producing such fiber reinforced material is called the infiltration soaking method, or the autoclave method. In this method, fiber is filled into a container, the fiber filled container is then evacuated of atmosphere, and then molten matrix metal is admitted into the container under pressure, so that this molten matrix metal infiltrates into the fiber within the container. Typically a fairly low pressure, such as 200 kg/cm$^2$, is used. This method, also, requires the use of a vacuum device for producing a vacuum, in order to provide good contact between the matrix metal and the reinforcing material at their interface, without interference caused by atmospheric air trapped in the interstices of the fiber mass. In fact, if the combination of the reinforcing material and the matrix metal has poor wettability, a good resulting fiber reinforced material cannot be obtained. As a counter measure against this, it can be practiced, if the matrix metal is aluminum or an alloy thereof, to add a few percent of lithium to the matrix metal, so as to improve the wetting of the reinforcing fiber by the matrix metal; but this is expensive, due to the high cost of lithium. Yet further, this autoclave method also has the additional disadvantage that, if the molten matrix metal is magnesium, it is difficult to attain the required proper high degree of vacuum, due to the high vapor pressure of molten magnesium.

There is a further third method known for making fiber reinforced material, which does not use a vacuum device. In this method, the so called high pressure casting method, after charging a mold with reinforcing fiber, molten matrix metal is poured into the mold and is pressurized to a high pressure exceeding 1000 kg/cm$^2$, and this high pressure forces the molten matrix metal to infiltrate into the interstices of the reinforcing material mass. Then the combination of the reinforcing material mass and the matrix metal is cooled down, while still being kept under this high pressure, until all the matrix metal has completely solidified.

This method has a certain degree of workability; but the difficulty arises that, since the temperature of the reinforcing material is less than the temperature of the molten matrix metal at the start of infiltration of the molten matrix metal into the interstices of the reinforcing material mass under pressure, this cools down the molten matrix metal, as it infiltrates into the reinforcing material mass, and causes it to at least partially solidify. Thereby, even when a high pressure like 1000 kg/cm$^2$ is used, this infiltration pressure is insufficient, and it is found that the infiltration resistance of the reinforcing material mass to the molten matrix metal is too great. Accordingly, buckling of the reinforcing material mass, and change in the local density of the material thereof, occurs; and it is hard to obtain a resulting reinforced material of good and uniform composition and properties.

As a counter measure, it can be adopted to reduce the volume ratio of the reinforcing material mass, i.e. the proportion of its volume actually occupied by reinforcing material, to a low value such as 20% to 30%. However, it is generally desirable to use a greater volume ratio of reinforcing material than such a low ratio, from the point of view of obtaining desirable characteristics of the resulting composite material. Accordingly, this solution is not a welcome one, and is not suitable for general practice.

In this connection, two different methods have been used, in the prior art, for keeping the reinforcing material from being buckled and displaced, when the molten matrix metal is being infiltrated thereinto. One such method is to form the reinforcing material such as a fibrous mass into the shape of a mat, in advance; but this suffers from the limitation that the nature, density, shape, and fiber orientation of the reinforcing material are limited and constrained by the requirement that it should be formable into a mat. Another possibility has been to retain the reinforcing material in the desired shape and density by fitting the reinforcing material into a cavity formed in the casting mold, against the sides of the casting mold; but this solution suffers from the defect that, since the cavity retaining the reinforcing material is closely surrounded by the sides of the casting mold, and the molten matrix metal charged in the molding cavity is rapidly cooled, good composition of the reinforcing material and the matrix metal becomes difficult. Further, it can be quite hard to remove the resulting composite material from the casting mold, because it is in close proximity to the sides of the casting mold, if this method is used.

Sometimes, further, difficulties arise with regard to the thermal expansion of the reinforcing material, during the infiltration thereof by molten matrix metal, and the subsequent cooling. This can disturb the proper operation of any restraining means used for the reinforcing material mass.

SUMMARY OF THE INVENTION

Accordingly, it is the primary object of the present invention to provide a method for making a composite material of reinforcing material and matrix metal, in which no vacuum device is required.

It is a further object of the present invention to provide such a method for making a composite material of reinforcing material and matrix metal, using no vacuum device, in which the matrix metal is smoothly and properly infiltrated into a porous structure of the reinforcing material.

It is a further object of the present invention to provide such a method for making a composite material of reinforcing material and matrix metal, using no vacuum device, in which air which is initially present in the porous structure of the reinforcing material is efficiently evacuated therefrom.

It is a further object of the present invention to provide such a method for making a composite material of reinforcing material and matrix metal, using no vacuum device, in which it does not occur that gas present in a porous structure of the reinforcing material interferes with the infiltration of the molten matrix metal thereinto.

It is a further object of the present invention to provide such a method for making a composite material of reinforcing material and matrix metal, using no vacuum device, in which close contact between the reinforcing material and the matrix metal is obtained.

It is a further object of the present invention to provide such a method for making a composite material of reinforcing material and matrix metal, using no vacuum device, in which the composite material includes a multitude of fibers, and in which the orientation of these fibers is arranged to cooperate with said evacuation of the air originally permeating a porous structure of said reinforcing material.

It is a further object of the present invention to provide such a method for making a composite material of reinforcing material and matrix metal, using no vacuum device, in which the solidification of the composite material, after molten matrix metal has been infiltrated into a porous structure of the reinforcing material, is performed in a way which promotes good properties for the resulting composite material.

It is a further object of the present invention to provide such a method for making a composite material of reinforcing material and matrix metal, using no vacuum device, in which the resulting composite material has uniform characteristics.

It is a further object of the present invention to provide such a method for making a composite material of reinforcing material and matrix metal, using no vacuum device, in which the volume density of the reinforcing fiber can be quite high.

It is a further object of the present invention to provide such a method for making a composite material of reinforcing material and matrix metal, using no vacuum device, in which the volume density of the reinforcing fiber can be as high as 50% or even higher.

It is a further object of the present invention to provide such a method for making a composite material of reinforcing material and matrix metal, using no vacuum device, in which no substantial local variations in fiber density occur in the resulting composite material.

It is a further object of the present invention to provide such a method for making a composite material of reinforcing material and matrix metal, using no vacuum device, in which no buckling in the reinforcing fiber mass is caused, when the matrix metal is commingled therewith.

It is a further object of the present invention to provide such a method for making a composite material of reinforcing material and matrix metal, using no vacuum device, in which a combination of reinforcing material and matrix metal may be used that does not have very good wettability, without the need for the use of any expensive wetting agent such as lithium.

It is a further object of the present invention to provide such a method for making a composite material of reinforcing material and matrix metal, using no vacuum device, in which the reinforcing material is kept in a desired shape, while it is being infiltrated with matrix metal.

It is a further object of the present invention to provide such a method for making a composite material of reinforcing material and matrix metal, using no vacuum device, in which the reinforcing material is kept with a desired density, while it is being infiltrated with matrix metal.

It is a further object of the present invention to provide such a method for making a composite material of reinforcing material and matrix metal, using no vacuum device, in which the reinforcing material is kept to have a desired fiber orientation, while it is being infiltrated with matrix metal.

It is a further object of the present invention to provide such a method for making a composite material of reinforcing material and matrix metal, using no vacuum device, in which a good degree of heat insulation is provided between the reinforcing material and a casting mold.

It is a further object of the present invention to provide such a method for making a composite material of reinforcing material and matrix metal, using no vacuum device, in which matrix metal is economized.

It is a further object of the present invention to provide such a method for making a composite material of reinforcing material and matrix metal, using no vacuum device, in which the resulting composite material is easily isolated after manufacture, ready for use.

It is a further object of the present invention to provide such a method for making a composite material of reinforcing material and matrix metal, using no vacuum device, in which no problem arises with the thermal expansion of the reinforcing material, during the infiltration thereof by molten matrix metal, and the subsequent cooling.

It is a further object of the present invention to provide such a method for making a composite material of reinforcing material and matrix metal, using no vacuum device, in which the molten matrix metal can get all around the reinforcing material, while it is infiltrating thereinto.

It is a further object of the present invention to provide such a method for making a composite material of reinforcing material and matrix metal, using no vacuum device, in which a proper material for the reinforcing material is selected.

It is a further object of the present invention to provide such a method for making a composite material of reinforcing material and matrix metal, using no vacuum device, in which a proper material for the matrix metal is selected.

According to the present invention, these and other objects are accomplished by a method of producing a composite material from reinforcing material and molten matrix metal, comprising the steps, performed in the specified order, of: (a) heating up a porous structure of reinforcing material to a temperature substantially above the melting point of said matrix metal; (b) infiltrating said molten matrix metal into said porous structure of reinforcing material under a substantial pressure; and (c) cooling the combination of said porous structure of reinforcing material and said matrix metal infiltrated thereinto down to a temperature below the melting point of said matrix metal while maintaining said pressure.

According to such a method, because the reinforcing material is preheated, before it is attempted to infiltrate the matrix metal into it, to a temperature substantially above the melting point of the matrix metal, thereby no problem arises of cooling down of the molten matrix metal, as it infiltrates into the reinforcing material mass; and thus partial solidification of the molten matrix metal as it infiltrates into the reinforcing material mass is precluded.

Further, according to a particular aspect of the present invention, these and other objects are more particularly and concretely accomplished by a method of producing a composite material as described above, wherein during step (b) said reinforcing material is restrained by a solid case which fits closely around said reinforcing material.

According to such a method, this case keeps the mass of reinforcing material in good shape during the process of infiltration thereof by said matrix metal.

Further, according to a particular aspect of the present invention, these and other objects are more particularly and concretely accomplished by a method of producing a composite material as described above, wherein said case is formed with one and only one opening; and wherein, during step (a), said reinforcing material is charged into said case so as to leave a space within said case not substantially occupied by said reinforcing material remote from said one opening, with said reinforcing material intercepting communication from said one opening to said space.

According to such a method, the provision of said space is substantially helpful, in addition, for aiding the smooth passing of the molten matrix metal into and through the interstices of the porous structure of reinforcing material, because the reinforcing material intercepts between the space and the opening of the case, and thus intercepts passage of molten matrix metal from said case opening to fill said space, said substantial pressure forcing said molten matrix metal to move so as to fill said space. In other words, said space provides a kind of sink toward which the air existing in the interstices of the porous structure of the reinforcing material can escape, as the molten matrix metal is charged into and through the interstices of the porous structure of the reinforcing material from said opening of said case.

Further, according to a particular aspect of the present invention, these and other objects are more particularly and concretely accomplished by a method of producing a composite material as described above, using a case, wherein, during step (a), said reinforcing material is charged into said case; but then, as said reinforcing material is subsequently heated up, said case is not substantially heated up.

According to such a method, when the case is made of material which has a good heat insulation characteristic, the case provides a good heat insulator for the mass of reinforcing material; and in any event, during the infiltration of the porous structure of reinforcing material by the molten matrix metal, it is much less likely that the molten matrix metal will become attached to said case, since said case is relatively cold, so that the molten matrix metal is immediately solidified as it touches said case; and further, if the case is made of a material of a low electrical conductivity, so that the reinforcing material charged therein may be heated up by high frequency electrical induction while the case itself is not very much heated up, then such a relatively low electrically conductive material generally exhibits a low affinity to molten metal. If said case is in fact made of refractory brick, then, because after heating up of the reinforcing material charged therein said case is still relatively cold, it is substantially completely prevented that said molten matrix metal will infiltrate into the interstices of said case; and accordingly, when the time comes for removal of said case from around the resulting composite material made by commingling of the matrix metal with the reinforcing material, said case may be relatively easily broken away.

Further, according to an alternative particular aspect of the present invention, these and other objects are more particularly and concretely accomplished by a method of producing a composite material as initially described above, wherein during step (b) said reinforcing material is restrained by a flexible binding system which fits closely around said reinforcing material, a first part of said flexible binding system being movable relative to another part of said flexible binding system remote from said first part.

According to such a method, since the binding system is relatively flexible, it relatively easily conforms to the changes in size and shape of the mass of reinforcing material, caused by the reinforcing material being heated up and being cooled down, in a way which could never be preformed by a solid case of the sort described above.

Further, according to an alternative particular aspect of the present invention, these and other objects are more particularly and concretely accomplished by a method of producing a composite material as initially described above, wherein during step (b) said reinforcing material is restrained by an open binding system which maintains said porous structure of reinforcing material, while leaving substantially all the outer surface of said porous structure of reinforcing material open for supply of the molten matrix material thereto.

According to such a method, since during infiltration of the porous structure of reinforcing material the molten matrix metal is readily supplied to any portion of the surface of the composite structure of the reinforcing material and the solidifying matrix metal, if at any time during the solidification process of the matrix metal an additional amount of molten matrix metal is required at any particular part thereof because of shrinkage of the molten matrix metal during its solidification, it is positively avoided that a cavity or a weakened portion should be formed in the resulting composite due to a lack of supply of molten matrix metal, such as could be caused in the event that the reinforcing material is restrained by a case.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

The present invention will now be described with reference to several preferred embodiments thereof, and with reference to the appended drawings.

THE FIRST EMBODIMENT

Figure 1:
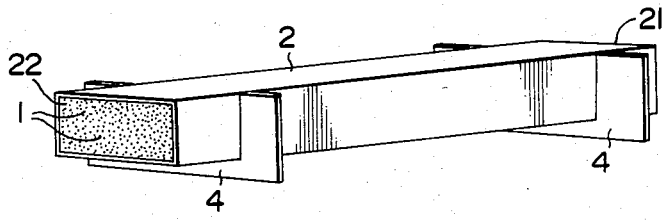
FIG. 1 is a schematic perspective view, showing a rectangular shaped stainless steel case, a bundle of reinforcing alumina fiber charged therein, and case supports for supporting the case, which are all of them elements involved in the practicing of a first preferred embodiment of the method for producing composite material according to the present invention.
Figure 2:
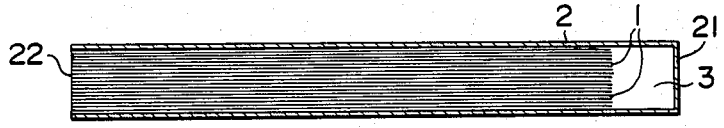
FIG. 2 is a sectional view of the elements shown in FIG. 1, except the supports, taken along a generally vertical plane extending in the longitudinal direction of the stainless steel case through the central portion thereof, for showing an empty space left between the alumina fiber bundle and the closed end of the case.
Figure 3:
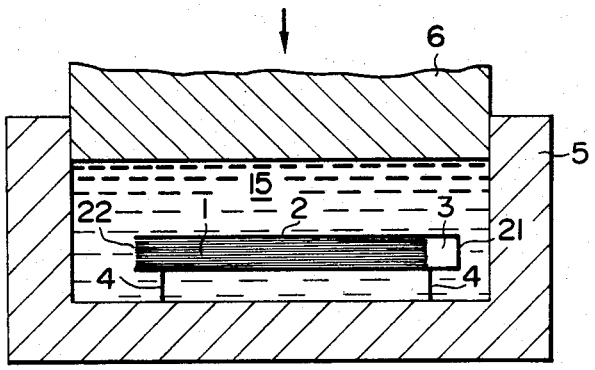
FIG. 3 is a sectional view, taken along a plane approximately the same as that of the section shown in FIG. 2, showing the stainless steel case with the alumina fiber bundle charged therein as placed in the cavity of a casting mold 5 which is charged with molten matrix metal, and as supported in said cavity on said case supports, and also showing a pressure plunger fitted into the upper part of the casting mold with which said plunger cooperates, for pressurizing the free upper surface of the molten matrix metal.

FIG. 1 is a schematic perspective view, and FIGS. 2 and 3 are sectional views, showing elements involved in the practicing of a first preferred embodiment of the method for producing composite material according to the present invention. The production of fiber reinforced material, in this first preferred embodiment, was carried out as follows.

A rectangular stainless steel case 2 was formed of stainless steel of JIS (Japanese Industrial Standard) SUS310S, and was 10 mm high, 20 mm wide, and 130 mm long. This stainless steel case 2 was formed with one closed case end 21 and one open case end 22, and was supported on a pair of case supports 4 which were mounted as extending transversely to the stainless steel case 2 and which were located slightly inwards of its two said ends 21 and 22. The stainless steel case 2 was charged with a bundle of reinforcing fiber 1, which in this first preferred embodiment of the method for producing composite material according to the present invention was so called FP alumina fiber made by Dupont. Said bundle of alumina reinforcing fiber 1 was 100 mm long, and the fibers of said bundle of alumina reinforcing fiber 1 were all aligned with substantially the same fiber orientation and were 20 microns in diameter. This charging of the stainless steel case 2 was performed in such a way that an empty space 3 was left between the closed case end 21 and the end of the bundle of alumina reinforcing fiber 1 adjacent thereto. The bundle of alumina reinforcing fiber 1 was squeezed by the stainless steel case 2 by such an amount that its volume ratio was approximately 50%; i.e. so that the proportion of the total volume of the bundle of alumina reinforcing fiber 1 actually occupied by alumina fiber was approximately 50%, the rest of this volume of course at this initial stage being occupied by atmospheric air. Further, in the shown first preferred embodiment, the orientation of the fibers of the bundle of alumina reinforcing fiber 1 was in the direction along the central axis of the stainless steel case 2.

Next, the stainless steel case 2 charged with the alumina reinforcing fiber 1 was preheated up to a temperature substantially higher than the melting point of the matrix metal which it was intended to use for commingling with said reinforcing fiber 1. In this first preferred embodiment, in which the intended matrix metal was pure aluminum, the stainless steel case 2 charged with alumina reinforcing fiber 1 was heated up to 750° C., which was a temperature substantially higher than 660° C., which is the melting point of aluminum metal.

Next, the heated stainless steel case 2 charged with the alumina reinforcing fiber 1 was placed into a casting mold 5, so that the stainless steel case 2 was supported on the two case supports 4 within said casting mold 5, and so that said stainless steel case 2 did not touch the sides of said casting mold 5. In other words, a heat insulating space was left between the outer surface of said stainless steel case 2 and the inner walls of said casting mold 5. At this time the casting mold 5 was preheated to a temperature of 300° C., in this first preferred embodiment. Because this mold preheat temperature of 300° C. was very much lower than the above mentioned case and reinforcing fiber preheat temperature of 900° C., if such a heat insulating space had not been left between the outer surface of said stainless steel case 2 and the inner walls of said casting mold 5, the stainless steel case 2 and the alumina reinforcing fiber bundle 1 charged therein would almost immediately have been cooled down by contact with the casting mold 5, and the practice of the process according to the present invention would have been be impossible. It should be noted that the stainless steel supports 4, because they were relatively thin, did not provide a very significant amount of conduction of heat from the stainless steel case 2 to the casting mold 5, at this time.

Next, a quantity of molten aluminum 15 at a temperature of approximately 850° C. (substantially above the melting point of aluminum, which is 660° C.) was poured briskly into the casting mold 5, so that the stainless steel case 2 charged with the alumina reinforcing fiber 1, still at substantially its aforesaid preheat temperature of 750° C., was submerged below the surface of said quantity of molten aluminum 15 contained in the casting mold 5. The upper free surface of the mass of molten aluminum 15 was then pressurized by a pressure plunger 6, which was forced into an upper part of the casting mold 5 with which said pressure plunger 6 cooperated closely, to a high pressure of approximately 1000 kg/cm$^2$. The pressure plunger 6 was previously preheated to approximately 200° C. The stainless steel case 2 charged with the alumina reinforcing fiber 1 was kept in this submerged condition under the molten aluminum 15 for a certain time, and during this time the molten aluminum 15 was gradually allowed to cool until said aluminum 15 all became completely solidified. The aforesaid high pressure of approximately 1000 kg/cm$^2$ was maintained during all this cooling period, until complete solidification of the mass of molten aluminum 15.

Finally, the stainless steel case 2 was removed by machining or the like from around the bundle of alumina reinforcing fiber 1, which had now become thoroughly infiltrated with the aluminum metal to form a cuboid of composite alumina fiber/aluminum material. It was found, in the first preferred embodiment described above, that substantially no voids existed between the fibers of this cuboid of composite alumina fiber/aluminum material, while an end blob of aluminum had become solidified in the formerly empty space 3 within the stainless steel case 2 near its closed case end 21. This end blob could of course have been removed and thrown away or recycled. It is presumed that the air which was originally present between the fibers of the cuboid of reinforcing fiber 1 was displaced by the flowing of the molten aluminum 15 through the inside of the stainless steel case 2 from its open case end 22 towards its closed case end 21, and that this air was swept into the empty space 3 at the closed case end 21, and was therein compressed into very small bubbles which could not be seen in the resulting blob of aluminum, mentioned above.

For this flowing, it is considered that the preheating of the stainless steel case 2 charged with the alumina reinforcing fiber 1 to a temperature substantially higher than the melting point of the aluminum matrix metal was absolutely essential, because otherwise the flowing aluminum matrix metal would have tended to solidify as it flowed between the alumina fibers of the bundle of alumina reinforcing fiber 1 charged within the stainless steel case 2, partly due to the high packing density of said alumina reinforcing fiber 1, and thus the free flowing of the aluminum matrix metal between the alumina fibers would have been prevented, causing bubbles or voids to be formed in the resulting composite material. Such preheating should be carried out to a temperature substantially higher than the melting point of the aluminum matrix metal, in order properly to fulfil its function.

At this time, the action of the stainless steel case 2 for maintaining the desired shape of the bundle 1 of reinforcing alumina fibers was very important. If no case such as the stainless steel case 2 had been provided, then the mass of reinforcing alumina fibers 1 would have tended to get out of shape, and also the density and orientation of these alumina fibers would have been disturbed, during the pouring of the molten aluminum matrix metal thereonto; and thereby the quality of the resulting alumina fiber/aluminum composite material formed would have been deteriorated.

Further, it is presumed that the pressure applied to the upper free surface of the mass of molten aluminum 15 by the pressure plunger 6 was important for forcing the molten aluminum matrix metal to flow between the alumina fibers of the alumina fiber bundle 1. If no such pressure had been applied, it is not considered that a good composite material would have been produced. The fact that this pressure was high, of an order of 1000 kg/cm$^2$, is considered to have been important.

Yet further, it is presumed that the provision of the empty space 3 was substantially helpful, in addition, for aiding the smooth passing of the molten matrix metal into and through the interstices of the bundle of alumina reinforcing fiber 1, because the bundle of alumina reinforcing fiber 1 was located between the empty space 3 and the open case end 22 of the stainless steel case 2, and thus intercepted passage of molten matrix metal from said open case end 22 to fill said empty spaced 3. In other words, said space 3 provides a kind of sink toward which the air existing in the interstices of the porous structure of the reinforcing alumina fiber mass 1 can escape, as the molten matrix metal is charged into and through the interstices of the porous structure of the reinforcing alumina fiber mass 1 from said opening of said case 2. In this connection, it was advantageous for the orientation of the fibers of the bundle of alumina reinforcing fiber 1 to be generally in the direction along the central axis of the stainless steel case 2, because according to this orientation the molten aluminum matrix metal could more freely flow along said central axis, from said open case end 22 of said stainless steel case 2 towards said empty space 3 at the closed case end 21 thereof.

Thus, according to the method described, the air which was originally present between the fibers of the bundle of alumina reinforcing fiber 1 did not subsequently impede the good contacting together of the molten aluminum matrix metal and of the alumina fibers of the bundle of alumina reinforcing fiber 1. Thus the same functional effect was provided, in this first preferred embodiment of the method for producing composite material according to the present invention, as was provided by the vacuum used in the prior art methods described above, i.e. it was prevented that atmospheric air trapped between the fibers of the bundle of alumina reinforcing fiber 1 should impede the infiltration of the molten aluminum matrix metal therebetween, even though the density of the reinforcing alumina fiber mass 1 was relatively high; and this effect was provided without the need for provision of any vacuum device.

When a tensile strength test was performed upon such a piece of composite alumina fiber/aluminum material made in such a way as described above, at 0° fiber orientation, a tensile strength of 55 kg/mm$^2$ to 60 kg/mm$^2$ was recorded. This is quite comparable to the tensile strength of an alumina fiber/aluminum composite material which has been made by either of the above described inefficient conventional methods, i.e. the diffusion adhesion method or the autoclave method.

Figure 4:
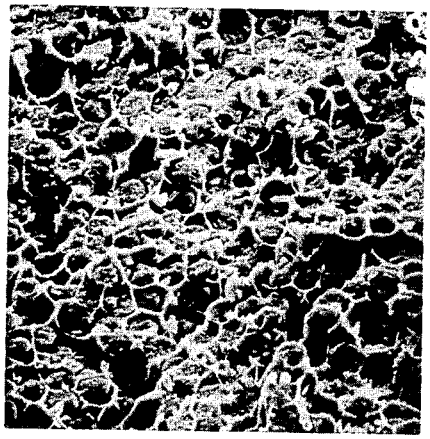
FIG. 4 is a scanning electron microscope photograph of the broken surface of a piece of the composite material produced by said method which is a first preferred embodiment of the method for producing composite material according to the present invention, and showing that no substantial pulling out of the alumina fibers of this composite material has occurred, even when the composite material was stressed to its breaking point.

In FIG. 4, there is shown a scanning electron microscope photograph of the broken surface of a piece of the composite material produced by the method as explained above, according to the first preferred embodiment of the method for producing composite material according to the present invention. As will be readily appreciated, no substantial pulling out of the alumina fibers of the composite material occurred, even when the composite material was stressed to its breaking point. Thus, the strength of the composite material was high and uniform.

Figure 7:
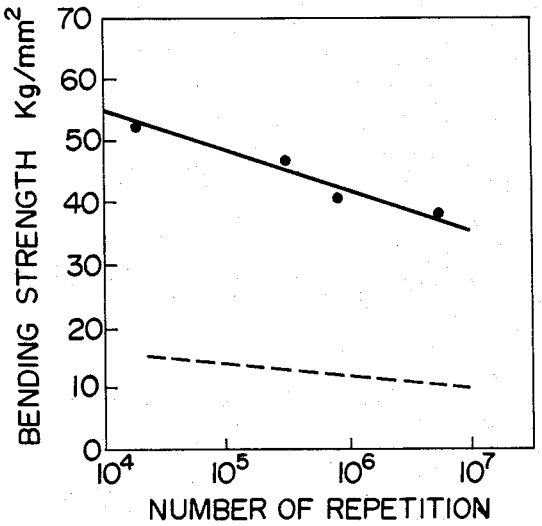
FIG. 7 is a graph, in which the number of repetitions of bending is the abscissa, and bending strength is the ordinate, showing the performance of a piece of the alumina fiber/aluminum composite material produced by the method according to the first preferred embodiment of the method for producing composite material according to the present invention, when subjected to a four point bending fatigue test at zero degree fiber orientation, showing that in this case the composite material exhibits an excellent strength under mechanical bending, and also showing the performance of a piece of cast aluminum when subjected to a similar test, which is significantly poorer.

. Further, when a piece of the composite material produced by the method as explained above, according to the first preferred embodiment of the present invention, was subjected to a four point bending fatigue test at zero degree fiber orientation, test results were obtained as shown in FIG. 7 by the solid line. As can be seen from this line, the composite material produced by the first preferred embodiment of the present invention showed an excellent strength under mechanical bending, such as a bending stress of 35 kg/mm$^2$ after $10^7$ bending repetitions. As an example for comparison, a piece of cast aluminum, JIS standard AC8P, was subjected to a similar test, and the results are shown in FIG. 7 by the dashed line. This cast aluminum, as can be seen, has a significantly poorer performance than the composite material produced according to the first preferred embodiment of the present invention.

COMPARISON EXAMPLE

Figure 5:
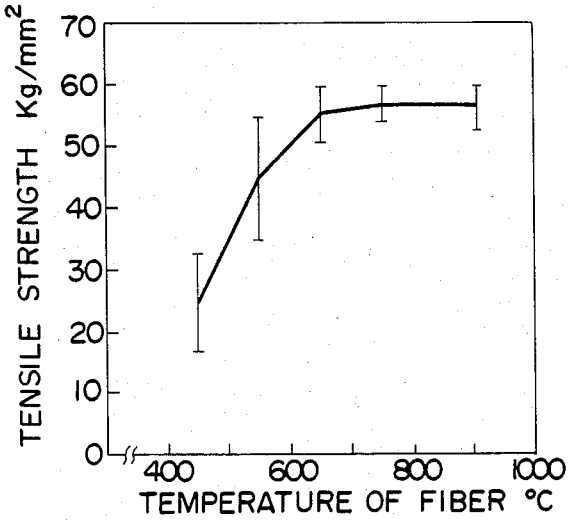
FIG. 5 is a graph, in which reinforcing fiber preheat temperature in degrees Centigrade is the abscissa, and composite material tensile strength is the ordinate, showing the results when various comparison pieces of composite alumina fiber/aluminum material were subjected to a tensile strength test at 0° fiber orientation, and proving that the tensile strength of the composite material produced by methods, similar to said method which is a first preferred embodiment of the method for producing composite material according to the present invention except that the preheat temperature for the reinforcing fiber is varied, increases sharply with increasing fiber preheat temperature, until this preheat temperature becomes substantially higher than the melting point of the aluminum matrix metal, and thenceforward with further increasing preheat temperature does not significantly increase.

In order to test the importance of the preheating step for the stainless steel case 2 charged with the reinforcing alumina fiber 1, five comparison pieces of composite alumina fiber/aluminum material were produced, using a process of the same sort as described above, except that the preheat temperature for the stainless steel case 2 charged with the alumina reinforcing fiber 1 was respectively 450° C., 550° C., 650° C., 750° C., and 900° C. Thus, only the last two of these pieces of composite material were produced by methods which were embodiments of the method according to the present invention, because the preheat temperatures in the cases of the other three pieces were below the melting point of the aluminum matrix metal, contrary to the essential concept of the present invention. Again, each of these comparison pieces of composite alumina fiber/aluminum material was subjected to a tensile strength test at 0° fiber orientation, and the results are shown in FIG. 5. It will be understood from this figure that the tensile strength of the composite material produced by the method explained above increases sharply with increasing preheat temperature for the stainless steel case 2 charged with the reinforcing alumina fiber 1, until this preheat temperature becomes substantially higher than the melting point of the matrix metal (in this case this melting point is the melting point of aluminum, 660° C.); and thenceforward, with further increasing preheat temperature for the stainless steel case 2 charged with the reinforcing alumina fiber 1, the tensile strength of the composite material does not significantly increase.

Figure 6:
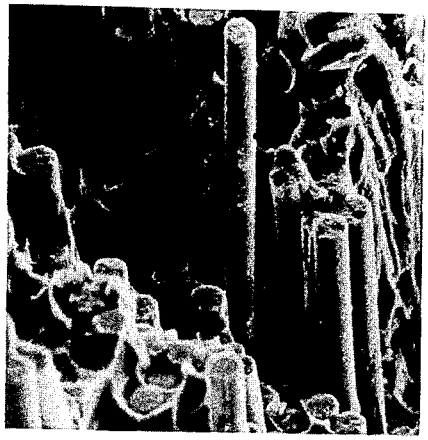
FIG. 6 is a scanning electron microscope photograph of the broken surface of the first comparison piece of composite material produced by a method of the sort detailed above, in the case where the reinforcing fiber preheat temperature was 450° C., and showing that in this case substantial pulling out of the alumina fibers of the composite material occurred when the composite material was stressed to its breaking point.

FIG. 6 is a scanning electron microscope photograph of the broken surface of the first piece of composite material produced by the method as explained above, in the case where the preheat temperature for the stainless steel case 2 charged with the reinforcing alumina fiber 1 was 450° C. As will be readily appreciated, substantial pulling out of the alumina fibers of the composite material occurred when the composite material was stressed to its breaking point. Thus, the strength of the low preheat temperature type composite material (which is not produced according to any embodiment of the method of the present invention) is much inferior to the strength of the composite material produced according to the first preferred embodiment, which involved a preheat temperature for the stainless steel case 2 charged with the reinforcing alumina fiber 1 of 750° C., substantially higher than the melting point of the aluminum matrix metal.

THE SECOND EMBODIMENT

FIGS. 1 through 3 will now be used for explaining a second preferred embodiment. The production of fiber reinforced material, in this second preferred embodiment, was carried out as follows.

A rectangular stainless steel case 2 was formed of stainless steel of JIS (Japanese Industrial Standard) SUS310S, and was 10 mm high, 20 mm wide, and 130 mm long. This stainless steel case 2 was formed with one closed case end 21 and one open case end 22, and was supported on a pair of case supports 4 which were mounted as extending transversely to the stainless steel case 2 and which were located slightly inwards of its two said ends 21 and 22. The stainless steel case 2 was charged with a bundle of reinforcing fiber 1, which in this second preferred embodiment was so called Torayca M40 type high elastic modulus carbon fiber made by Toray Co. Ltd. Said bundle of carbon reinforcing fiber 1 was 100 mm long, and the fibers of said bundle of carbon reinforcing fiber 1 were all aligned with substantially the same fiber orientation and were 7 microns in diameter. This charging of the stainless steel case 2 was performed in such a way that an empty space 3 was left between the closed case end 21 and the end of the bundle of carbon reinforcing fiber 1 adjacent thereto. The bundle of carbon reinforcing fiber 1 was squeezed by the stainless steel case 2 by such an amount that its volume ratio was approximately 60%; i.e. so that the proportion of the total volume of the bundle of carbon reinforcing fiber 1 actually occupied by carbon fiber was approximately 60%, the rest of this volume of course at this initial stage being occupied by atmospheric air. Further, in the shown second preferred embodiment, the orientation of the fibers of the bundle of carbon reinforcing fiber 1 was again in the direction along the central axis of the stainless steel case 2.

Next oxygen was blown into a part of the stainless steel case 2 and gas was exhausted from another part thereof. Thus, of course, initially the exhausted gas was atmospheric air, and subsequently the exhausted gas was a mixture of atmospheric air and oxygen; but, as the oxygen being blown in at said first part of the stainless steel case 2 progressively displaced the atmospheric air within the empty space 3 at the closed case end 21 of the stainless steel case 2, and percolated along between the carbon fibers of the carbon fiber bundle 1 and displaced the atmospheric air present therebetween, the gas which was exhausted from said other part of the stainless steel case 2 progressively to a greater and greater extent became composed of pure oxygen. When this exhausted gas came to be composed of substantially pure oxygen, it was presumed that substantially all of the atmospheric air had been displaced from between the carbon fibers of the carbon fiber bundle 1, and from the empty space 3.

It should be understood that this concept of feeding and infiltrating oxygen into the stainless steel case 2 and between the carbon fibers of the carbon fiber bundle 1 and within the empty space 3 is not substantially related to the present invention, but is an independent inventive concept, and is described and claimed in copending U.S. patent application Ser. No. 282,185, filed by one of the present inventors, and assigned to the same assignee as the present application.

Next, the stainless steel case 2 charged with the carbon reinforcing fiber 1 was plunged into a quantity of molten magnesium at a temperature of 750° C., (substantially above the melting point of magnesium, which is 650° C.), to be preheated. By this preheating the oxygen charged in the stainless steel case reacted with the molten magnesium and the stainless steel case charged with the carbon reinforcing fiber was partly filled with molten magnesium.

Next, the stainless steel case 2 charged with the carbon reinforcing fiber 1 and partly filled with molten magnesium and preheated up to a temperature of 750° C. was placed into a casting mold 5, so that the stainless steel case 2 was supported on the two case supports 4 within said casting mold 5, and so that said stainless steel case 2 did not touch the sides of said casting mold 5. At this time the casting mold 5 was preheated to a temperature of 300° C., in this second preferred embodiment.

Next, a quantity of molten magnesium 15 at a temperature of approximately 750° C. was poured briskly into the casting mold 5, over the stainless steel case 2 charged with the carbon reinforcing fiber 1, and accordingly the stainless steel case 2 charged with the carbon reinforcing fiber 1 was submerged below the surface of said quantity of molten magnesium 15 contained in the casting mold 5.

The upper free surface of the mass of molten magnesium 15 was then pressurized by a pressure plunger 6, which was forced into an upper part of the casting mold 5 with which said pressure plunger 6 cooperated closely, to a high pressure of approximately 1000 kg/cm$^2$. The stainless steel case 2 charged with the carbon reinforcing fiber 1 was kept in this submerged condition under the molten magnesium 15 for a certain time, and during this time the molten magnesium 15 was gradually allowed to cool until said magnesium 15 all became completely solidified. The aforesaid high pressure of approximately 1000 kg/cm$^2$ was maintained during all this cooling period, until complete solidification of the mass of molten magnesium 15.

Finally, the stainless steel case 2 was removed by machining or the like from around the bundle of carbon reinforcing fiber 1, which had become thoroughly infiltrated with the magnesium metal to form a cuboid of composite carbon fiber/magnesium material. It was found, in the second preferred embodiment of the present invention described above, that substantially no voids existed between the fibers of this cuboid of composite carbon fiber/magnesium material, while an end blob of magnesium hads become solidified in the formerly empty space 3 within the stainless steel case 2 near its closed case end 21. This end blob of course could have been removed and thrown away or recycled. It was found, in this second preferred embodiment of the method according to the present invention described above, that substantially no voids existed in the lump of magnesium which had been solidified within the formerly empty space 3 adjacent to the closed case end 21 of the stainless steel case 2. It is presumed that the oxygen which was originally present in these spaces, by combining with and oxidizing a small inconsiderable part of the molten magnesium matrix metal mass, had disappeared without leaving any substantial remnant (the small amount of magnesium oxide which was formed not substantially affecting the characteristics of the resulting composite carbon fiber/magnesium material), thus not impeding the good contacting together of the molten magnesium matrix metal and of the carbon fibers of the carbon fiber bundle 1. It is presumed that the air which was originally present between the fibers of the cuboid of reinforcing fiber 1 was displaced by the flowing of oxygen in to replace this air, as explained above, and that this oxygen was eliminated by the flowing of the molten magnesium 15 through the inside of the stainless steel case 2 from its open case end 22 towards its closed case end 21.

For this flowing, it is considered that the preheating of the stainless steel case 2 charged with the carbon reinforcing fiber 1 to a temperature substantially higher than the melting point of the magnesium matrix metal was absolutely essential, because otherwise the flowing magnesium matrix metal would have tended to solidify as it flowed between the carbon fibers of the bundle of carbon reinforcing fiber 1 charged within the stainless steel case 2, partly due to the high packing density of said carbon reinforcing fiber 1, and thus the free flowing of the magnesium matrix metal between the carbon fibers would have been prevented, causing bubbles or voids to be formed in the resulting composite material. Such preheating should be carried out to a temperature substantially higher than the melting point of the magnesium matrix metal, in order properly to fulfil its function; and this was provided, in the shown second preferred embodiment, by the temperature of the molten magnesium mass 15 poured into the casting mold 5 being substantially higher than the melting point of said magnesium.

Further, it is also presumed that the pressure applied to the upper free surface of the mass of molten magnesium 15 by the pressure plunger 6 was important for forcing the molten magnesium matrix metal to flow between the carbon fibers of the carbon fiber bundle 1. If no such pressure had been applied, it is not considered that a good composite material would have been produced. The fact that this pressure was high, of an order of 1000 kg/cm$^2$, is considered to be important.

Although it is also presumed that the provision of the empty space 3 was helpful, in addition, for aiding the smooth passing of the molten matrix metal into and through the interstices of the bundle of carbon reinforcing fiber 1, because the bundle of carbon reinforcing fiber 1 was located between the empty space 3 and the open case end 22 of the stainless steel case 2, and thus intercepted passage of molten matrix metal from said open case end 22 to fill said empty space 3, and therefore, in other words, said space 3 provided a source of vacuum as the oxygen in the space reacted with the molten metal and substantially lost its volume, as the molten matrix metal was charged into and through the interstices of the porous structure of the reinforcing carbon fiber mass 1 from said opening of said case 2, the empty space 3 is not essential in this second embodiment wherein the air existing in the case 2 had been replaced by oxygen. In this connection, it is advantageous for the orientation of the fibers of the bundle of carbon reinforcing fiber 1 to be generally in the direction along the central axis of the stainless steel case 2, because according to this orientation the molten magnesium matrix metal can more freely flow along said central axis, from said open case end 22 of said stainless steel case 2 towards said empty space 3 at the closed case end 21 thereof.

Thus, according to the method described, the air which was originally present between the fibers of the bundle of carbon reinforcing fiber 1 again did not subsequently impede the good contacting together of the molten magnesium matrix metal and of the carbon fibers of the bundle of carbon reinforcing fiber 1. Thus the same functional effect was again provided, in this second preferred embodiment, as was provided by the vacuum used in the prior art methods described above, i.e. it was prevented that atmospheric air trapped between the fibers of the bundle of carbon reinforcing fiber 1 should impede the infiltration of the molten magnesium matrix metal therebetween, even though the density of the mass 1 of reinforcing carbon fibers was relatively high; and this effect was provided without the need for provision of any vacuum device.

When a tensile strength test was performed upon such a piece of composite carbon fiber/magnesium material made in such a way as described above, at 0° fiber orientation, a tensile strength of 80 kg/mm$^2$ was recorded. This is quite comparable to the tensile strength of a carbon fiber/magnesium composite material which has been made by either of the above described inefficient conventional methods, i.e. the diffusion adhesion method or the autoclave method.

THE THIRD EMBODIMENT

FIGS. 1 through 3 will now be again used for explaining a third preferred embodiment. The production of fiber reinforced material, in this third preferred embodiment, was carried out as follows.

A rectangular stainless steel case 2 was formed of stainless steel of JIS (Japanese Industrial Standard) SUS310S, and was 10 mm high, 20 mm wide, and 130 mm long. This stainless steel case 2 was formed with one closed case end 21 and one open case end 22, and was supported on a pair of case supports 4 which were mounted as extending transversely to the stainless steel case 2 and which were located slightly inwards of its two said ends 21 and 22. The stainless steel case 2 was charged with a bundle of reinforcing fiber 1, which in this third preferred embodiment was boron fiber made by AVCO, of approximately 120 microns fiber diameter. Said bundle of boron reinforcing fiber 1 was 100 mm long, and the fibers of said bundle of boron reinforcing fiber 1 were all aligned with substantially the same fiber orientation. This charging of the stainless steel case 2 was performed in such a way that an empty space 3 was left between the closed case end 21 and the end of the bundle of boron reinforcing fiber 1 adjacent thereto. The bundle of boron reinforcing fiber 1 was squeezed by the stainless steel case 2 by such an amount that its volume ratio was approximately 60%; i.e. so that the proportion of the total volume of the bundle of boron reinforcing fiber 1 actually occupied by boron fiber was approximately 60%, the rest of this volume of course at this initial stage being occupied by atmospheric air. Further, in the shown third preferred embodiment, the orientation of the fibers of the bundle of boron reinforcing fiber 1 was in the direction along the central axis of the stainless steel case 2.

Next oxygen was blown into a part of the stainless steel case 2 and gas was exhausted from another part thereof. Thus, of course, initially the exhausted gas was atmospheric air, and subsequently the exhausted gas was a mixture of atmospheric air and oxygen; but, as the oxygen being blown in at said first part of the stainless steel case 2 progressively displaced the atmospheric air within the empty space 3 at the closed case end 21 of the stainless steel case 2, and percolated along between the boron fibers of the boron fiber bundle 1 and displaced the atmospheric air present therebetween, the gas which was exhausted from said other part of the stainless steel case 2 progressively to a greater and greater extent became composed of pure oxygen. When this exhausted gas came to be composed of substantially pure oxygen, it was presumed that substantially all of the atmospheric air had been displaced from between the boron fibers of the boron fiber bundle 1, and from the empty space 3.

It should be understood that this concept of feeding and infiltrating oxygen into the stainless steel case 2 and between the boron fibers of the boron fiber bundle 1 and within the empty space 3 is not substantially related to the present invention, but is an independent inventive concept, and is described and claimed in copending U.S. patent application Ser. No. 282,185, filed by one of the present inventors, and assigned to the same assignee as the present application.

Next, the stainless steel case 2 charged with the boron reinforcing fiber 1 was plunged into a quantity of molten magnesium at a temperature of 750° C., (substantially above the melting point of magnesium, which is 650° C.), to be preheated. By this preheating the oxygen charged in the stainless steel case reacted with the molten magnesium and the stainless steel case charged with the boron reinforcing fiber was partly filled with molten magnesium.

Next, the stainless steel case 2 charged with the boron reinforcing fiber 1 and partly filled with molten magnesium and preheated up to 750° C. was placed into a casting mold 5, so that the stainless steel case 2 was supported on the two case supports 4 within said casting mold 5, and so that said stainless steel case 2 did not touch the sides of said casting mold 5. At this time the casting mold 5 was preheated to a temperature of 300° C., in this third preferred embodiment.

Next, a quantity of molten magnesium 15 at a temperature of approximately 750° C. was poured briskly into the casting mold 5, so as to cover the stainless steel case 2 charged with the boron reinforcing fiber 1, and accordingly the stainless steel case 2 charged with the boron reinforcing fiber 1 was submerged below the surface of said quantity of molten magnesium 15 contained in the casting mold 5.

This heating of the stainless steel case 2 charged with the boron reinforcing fiber 1 may be termed preheating, because at this time the molten magnesium matrix metal had not yet been very substantially infiltrated into the porous structure of the boron reinforcing fiber 1, although affinity between magnesium and boron is relatively high and natural infiltration should have occurred to some extent without the next step of pressurizing the surface of the molten magnesium to a high pressure.

The upper free surface of the mass of molten magnesium 15 was then pressurized by a pressure plunger 6, which was forced into an upper part of the casting mold 5 with which said pressure plunger 6 cooperated closely, to a high pressure of approximately 1000 kg/cm$^2$. The stainless steel case 2 charged with the boron reinforcing fiber 1 was kept in this submerged condition under the molten magnesium 15 for a certain time, and during this time the molten magnesium 15 was gradually allowed to cool until said magnesium 15 all became completely solidified. The aforesaid high pressure of approximately 1000 kg/cm$^2$ was maintained during all this cooling period, until complete solidification of the mass of molten magnesium 15.

Finally, the stainless steel case 2 was removed by machining or the like from around the bundle of boron reinforcing fiber 1, which had now become thoroughly infiltrated with the magnesium metal to form a cuboid of composite boron fiber/magnesium material. It was found, in the third preferred embodiment described above, that substantially no voids existed between the fibers of this cuboid of composite boron fiber/magnesium material, while an end blob of magnesium had become solidified in the formerly empty space 3 within the stainless steel case 2 near its closed case end 21. This end blob could of course have been removed and thrown away or recycled. It was found, in this third preferred embodiment of the method according to the present invention described above, as in the case of the second preferred embodiment, that substantially no voids existed in the lump of magnesium which had been solidified within the formerly empty space 3 adjacent to the closed case end 21 of the stainless steel case 2. It is presumed that the oxygen which was originally present in these spaces, by combining with and oxidizing a small inconsiderable part of the molten magnesium matrix metal mass, had disappeared without leaving any substantial remnant (the small amount of magnesium oxide which was formed not substantially affecting the characteristics of the resulting composite boron fiber/magnesium material), thus not impeding the good contacting together of the molten magnesium matrix metal and of the boron fibers of the boron fiber bundle 1. It is presumed that the air which was originally present between the fibers of the cuboid of reinforcing fiber 1 was displaced by the flowing of oxygen in to replace this air, as explained above, and that this oxygen was eliminated by the flowing of the molten magnesium 15 through the inside of the stainless steel case 2 from its open case end 22 towards its closed case end 21.

For this flowing, it is considered that the preheating of the stainless steel case 2 charged with the boron reinforcing fiber 1 to a temperature substantially higher than the melting point of the magnesium matrix metal was absolutely essential, because otherwise the flowing magnesium matrix metal would have tended to solidify as it flowed between the boron fibers of the bundle of boron reinforcing fiber 1 charged within the stainless steel case 2, partly due to the high packing density of said boron reinforcing fiber 1, and thus the free flowing of the magnesium matrix metal between the boron fibers would have been prevented, causing bubbles or voids to be formed in the resulting composite material. Such preheating should be carried out to a temperature substantially higher than the melting point of the magnesium matrix metal, in order properly to fulfil its function; and this was provided, in the shown third preferred embodiment, by the temperature of the molten magnesium mass 15 poured into the casting mold 5 being substantially higher than the melting point of said magnesium.

Further, it is presumed that the pressure applied to the upper free surface of the mass of molten magnesium 15 by the pressure plunger 6 was important for forcing the molten magnesium matrix metal to flow between the boron fibers of the boron fiber bundle 1. If no such pressure were applied, it is not considered that a good composite material would be produced. The fact that this pressure was high, of an order of 1000 kg/cm$^2$, is considered to be important.

Although it is presumed that the provision of the empty space 3 was helpful, in addition, for aiding the smooth passing of the molten matrix metal into and through the interstices of the bundle of boron reinforcing fiber 1, because the bundle of boron reinforcing fiber 1 was located between the empty space 3 and the open case end 22 of the stainless steel case 2, and thus intercepted passage of molten matrix metal from said open case end 22 to fill said empty space 3, and therefore, in other words, said space 3 provided a source of vacuum as the oxygen in the space reacted with the molten metal and substantially lost its volume, as the molten matrix metal was charged into and through the interstices of the porous structure of the reinforcing carbon fiber mass 1 from said opening of said case 2, the empty space 3 is not essential in this second embodiment wherein the air existing in the case 2 had been replaced by oxygen. In this connection, it is advantageous for the orientation of the fibers of the bundle of boron reinforcing fiber 1 to be generally in the direction along the central axis of the stainless steel case 2, because according to this orientation the molten magnesium matrix metal can more freely flow along said central axis, from said open case end 22 of said stainless steel case 2 towards said empty space 3 at the closed case end 21 thereof.

Thus, according to the method described, the air which was originally present between the fibers of the bundle of boron reinforcing fiber 1 did not subsequently impede the good contacting together of the molten magnesium matrix metal and of the boron fibers of the bundle of boron reinforcing fiber 1. Thus the same functional effect was provided, in this third preferred embodiment, as was provided by the vacuum used in the prior art methods described above, i.e. it was prevented that atmospheric air trapped between the fibers of the bundle of boron reinforcing fiber 1 should impede the infiltration of the molten magnesium matrix metal therebetween, even though the density of the reinforcing mass 1 of boron fibers was relatively high; and this effect was provided without the need for provision of any vacuum device.

When a tensile strength test was performed upon such a piece of composite boron fiber/magnesium material made in such a way as described above, at 0° fiber orientation, a tensile strength of 130 kg/mm$^2$ was recorded. This is quite comparable to the tensile strength of a boron fiber/magnesium composite material which has been made by either of the above described inefficient conventional methods, i.e. the diffusion adhesion method or the autoclave method.

THE FOURTH EMBODIMENT

Figure 8:
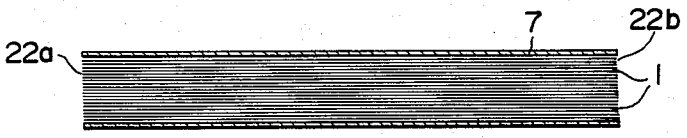
FIG. 8 is a sectional view taken, along a plane corresponding to the sectional plane of FIG. 2, through elements involved in the practicing of a fourth preferred embodiment of the method for producing composite material according to the present invention, in which fourth embodiment an empty space, left in the first through third embodiments between a closed case end of the stainless steel case and an end of the bundle of reinforcing fiber proximate thereto, is omitted.

In FIG. 8, there is shown a sectional view through elements involved in the practicing of a fourth embodiment, in a fashion similar to FIG. 2. In FIG. 8, parts of the elements involved in the practicing of the fourth embodiment shown which correspond to parts involved in the practicing of the first through third preferred embodiments, shown in FIGS. 1–3, and which have the same functions, are designated by the same reference numerals as in those figures.

In this embodiment, the empty space 3 in the first through third preferred embodiments, left between the closed case end 21 of the stainless steel case 2 and the end of the bundle of reinforcing fiber 1 proximate thereto, was omitted, in order to check whether the provision of said empty space 3 was important for the good results obtained in the first through third preferred embodiments. As will be later understood from the results of this process according to this fourth embodiment of the present invention, this empty space was found to be quite important, and accordingly this fourth embodiment is not generally a preferred one. However, in some cases, depending upon circumstances, the provision of such an empty space or air chamber could present problems, and in such cases this fourth embodiment of the present invention could well be a preferred one.

FIGS. 1 through 3 will now be used, in conjunction with FIG. 8, for explaining said fourth embodiment. Of course, in line with the non provision of the empty space 3, FIGS. 2 and 3 should be considered mutatis mutandis. The production of fiber reinforced material, in this fourth embodiment, was carried out as follows.

A rectangular stainless steel case 2 was formed of stainless steel of JIS (Japanese Industrial Standard) SUS310S, and was 10 mm high, 20 mm wide, and 100 mm long. This stainless steel case 2 was formed with two open case ends **22*a* and 22*b*, and was supported on a pair of case supports 4 which were mounted as extending transversely to the stainless steel case 2 and which were located slightly inwards of its two said open ends 22*a* and 22*b*. The stainless steel case 2 was charged with a bundle of reinforcing fiber 1, which in this fourth embodiment was so called FP alumina fiber made by Dupont. Said bundle of alumina reinforcing fiber 1 was 100 mm long (i.e., the same length as the stainless steel case 2), and the fibers of said bundle of alumina reinforcing fiber 1 were all aligned with substantially the same fiber orientation and are 20 microns in diameter. This charging of the stainless steel case 2 was performed in such a way that the open case ends 22*a* and 22*b* corresponded closely to the ends of the bundle of alumina reinforcing fiber 1 adjacent thereto. The bundle of alumina reinforcing fiber 1 was squeezed by the stainless steel case 2 by such an amount that its volume ratio was approximately 50%; i.e. so that the proportion of the total volume of the bundle of alumina reinforcing fiber 1 actually occupied by alumina fiber was approximately 50%, the rest of this volume of course at this initial stage being occupied by atmospheric air. Further, in the shown fourth embodiment, the orientation of the fibers of the bundle of alumina reinforcing fiber 1 was in the direction along the central axis of the stainless steel case 2**.

Next, the stainless steel case 2 charged with the alumina reinforcing fiber 1 was preheated up to a temperature substantially higher than the melting point of the matrix metal which it was intended to use for commingling with said reinforcing fiber 1. In this fourth embodiment, in which the intended matrix metal was aluminum metal, the stainless steel case 2 charged with alumina reinforcing fiber 1 was heated up to 750° C., which was a temperature substantially higher than 660° C., which is the melting point of aluminum metal.

Next, the heated stainless steel case 2 charged with the alumina reinforcing fiber 1 was placed into a casting mold 5, so that the stainless steel case 2 was supported on the two case supports 4 within said casting mold 5, and so that said stainless steel case 2 did not touch the sides of said casting mold 5. At this time the casting mold 5 was preheated to a temperature of 300° C., in this fourth embodiment. Because this mold preheat temperature of 300° C. was very much lower than the above mentioned case and reinforcing fiber preheat temperature of 900° C., if such a heat insulating space were not left between the outer surface of said stainless steel case 2 and the inner walls of said casting mold 5, the stainless steel case 2 and the alumina reinforcing fiber bundle 1 charged therein would almost immediately have been cooled down by contact with the casting mold 5, and the practice of the process according to the present invention would be impossible. It should be noted that the stainless steel supports 4, because they were relatively thin, did not provide a very significant amount of conduction of heat from the stainless steel case 2 to the casting mold 5, at this time.

Next, a quantity of molten aluminum 15 at a temperature of approximately 850° C. (substantially above the melting point of aluminum, which is 660° C.) was poured briskly into the casting mold 5, so that the stainless steel case 2 charged with the alumina reinforcing fiber 1, still at substantially its aforesaid preheat temperature of 750° C., was submerged below the surface of said quantity of molten aluminum 15 contained in the casting mold 5. The upper free surface of the mass of molten aluminum 15 was then pressurized by a pressure plunger 6, which was forced into an upper part of the casting mold 5 with which said pressure plunger 6 cooperated closely, to a high pressure of approximately 1000 kg/cm$^2$. The pressure plunger 6 was previously preheated to approximately 200° C. The stainless steel case 2 charged with the alumina reinforcing fiber 1 was kept in this submerged condition under the molten aluminum 15 for a certain time, and during this time the molten aluminum 15 was gradually allowed to cool until said aluminum 15 all became completely solidified. The aforesaid high pressure of approximately 1000 kg/cm$^2$ was maintained during all this cooling period, until complete solidification of the mass of molten aluminum 15.

Finally, the stainless steel case 2 was removed by machining or the like from around the bundle of alumina reinforcing fiber 1, which had now become quite well infiltrated with the aluminum metal to form a cuboid of composite alumina fiber/aluminum material.

When five test pieces were machined from this composite alumina fiber/aluminum material, made according to this fourth embodiment of the present invention, i.e. with no empty space 3 being left between any closed case end of the stainless steel case 2 and an end of the bundle of reinforcing fiber 1 proximate thereto, and when tensile strength tests were performed upon these pieces of composite alumina fiber/aluminum material, at 0° fiber orientation, tensile strengths of 45 kg/mm$^2$, 48 kg/mm$^2$, 50 kg/mm$^2$, 50 kg/mm$^2$, and 55 kg/mm$^2$ were recorded. Although not as good as the tensile strengths obtained with the practice of the first through third preferred embodiments of the method for producing composite material according to the present invention, these tensile strengths are reasonably comparable to the tensile strength of an alumina fiber/aluminum composite material which has been made by either of the above described inefficient conventional methods, i.e. the diffusion adhesion method or the autoclave method. However, the variation in these tensile strengths is comparatively rather great.

Figure 10:
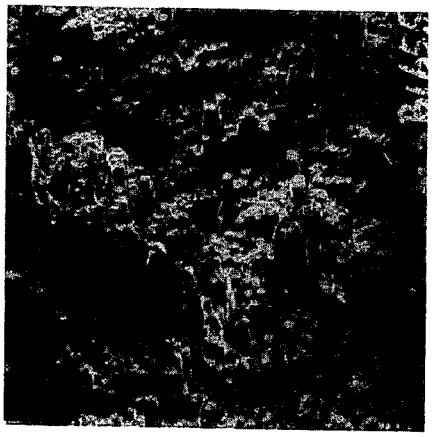
FIG. 10 is a scanning electron microscope photograph of the broken surface of one of five test pieces of alumina fiber/aluminum composite material produced by the method according to the fourth preferred embodiment of the method for producing composite material according to the present invention, showing that some pulling out of the alumina fibers of the composite material has occurred, when the composite material was stressed to its breaking point.

In FIG. 10, there is shown a scanning electron microscope photograph of the broken surface of one of the above described test pieces of the composite material produced by the method as explained above, according to the fourth embodiment. Actually, the one of these test pieces whose broken surface is shown is the one which had tensile strength of 45 kg/mm$^2$. As will be readily appreciated, some pulling out of the alumina fibers of the composite material occurred, when the composite material was stressed to its breaking point. Thus, the strength of the composite material was not so high, and was not so uniform, as in the case of the first through third preferred embodiments of the method for producing composite material according to the present invention. However, because this pulling out of the fibers of the composite alumina fiber/aluminum material was not extremely severe, the strength was not too much deteriorated.

As an example for comparison, five test pieces were machined from a composite alumina fiber/aluminum material, made according to the first preferred embodiment of the present invention, with an empty space 3 being left between a closed case end of the stainless steel case 2 and the end of the bundle of reinforcing fiber 1 proximate thereto, and when tensile strength tests were performed upon these pieces of composite alumina fiber/aluminum material, at 0° fiber orientation, tensile strengths of: 56 kg/mm$^2$, 58 kg/mm$^2$, 58 kg/mm$^2$, 59 kg/mm$^2$, and 59 kg/mm$^2$ were recorded. These tensile strengths are fully comparable to the tensile strength of an alumina fiber/aluminum composite material which has been made by either of the above described inefficient conventional methods, i.e. the diffusion adhesion method or the autoclave method, and are clearly somewhat better than the tensile strengths of the five test pieces, described above, made according to the fourth embodiment of the method for producing composite material according to the present invention. Further, the fluctuations in tensile strength between these various test pieces produced according to the first preferred embodiment are somewhat less than in the case of the test pieces produced according to the fourth embodiment of the present invention, described above. Thus it is clear that the provision of the empty space 3 left between a closed case end of the stainless steel case 2 and the end of the bundle of reinforcing fiber 1 proximate thereto was important (although not absolutely essential) for producing uniformly strong and good alumina fiber/aluminum composite material.

Figure 9:
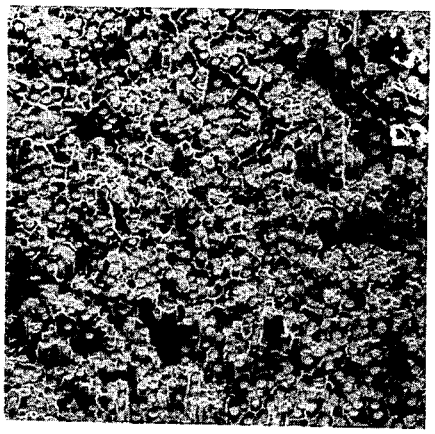
FIG. 9 is a scanning electron microscope photograph of the broken surface of one of five comparison pieces of alumina fiber/aluminum composite material produced by the method according to the first preferred embodiment of the method for producing composite material according to the present invention, showing that no substantial pulling out of the alumina fibers of the composite material has occurred, even when the composite material was stressed to its breaking point.

In FIG. 9, there is shown a scanning electron microscope photograph of the broken surface of one of said five comparison pieces of the composite material produced by the method as explained above, according to the first preferred embodiment. Actually, the one of these test pieces shown is the one which had tensile strength of 56 kg/mm$^2$. As will be readily appreciated, no substantial pulling out of the alumina fibers of the composite material occurred, even when the composite material was stressed to its breaking point. Thus, the strength of the composite material was higher and more uniform, when such an empty space as the empty space 3 of the first preferred embodiment was provided, than in the case of the fourth embodiment of the present invention, wherein no such empty space was provided. In other words, in the case in which an empty space 3 was provided, i.e. in the case of the first preferred embodiment, the contact between the fibers of the reinforcing material bundle 1 and the matrix metal was good, and accordingly the bonding together of said fibers and said matrix metal was good. On the other hand, in the case in which no empty space 3 was provided, i.e. in the case of the fourth embodiment, the contact between the fibers of the reinforcing material bundle 1 and the matrix metal was not so good, and accordingly the bonding together of said fibers and said matrix metal was not so good.

Next, again a stainless steel case 2 was charged with a bundle of alumina reinforcing fiber 1 so that an empty space 3 was left between a closed case end 21 of the case 2 and an end of the reinforcing alumina fiber bundle 1, in a fashion identical to that performed in the shown first preferred embodiment, and again as outlined above molten aluminum was poured around the case 2 and was pressurized to a high pressure of approximately 1000 kg/cm$^2$, until it solidified. Next, however, after the solidified aluminum had been roughly removed from around the stainless steel case 2, the stainless steel case 2 with the resulting composite alumina fiber/aluminum material produced according to the first preferred embodiment still charged within it was again submerged in molten aluminum, for a few minutes, without any pressure other than atmospheric pressure being applied thereto. Then, after this stainless steel case 2 and the bundle of reinforcing alumina fiber 1 now infiltrated with aluminum therein were removed from this molten aluminum, and after they had cooled, a longitudinal section (along a plane similar to that along which the section shown in FIG. 2 was taken) was cut through them.

Figure 11A:
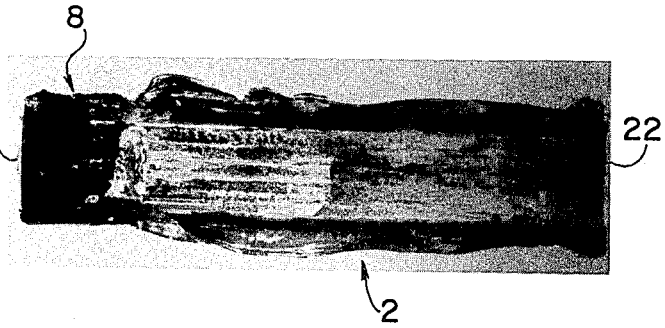
FIG. 11*a* is a photograph of a longitudinal section cut, along a plane similar to that along which the section shown in FIG. 2 is taken, through a stainless steel case and a bundle of alumina fiber charged therein, after molten aluminum has been infiltrated therein under pressure, according to the first preferred embodiment of the method for producing composite material according to the present invention, and after also this case and alumina fiber have been again put under the surface of molten aluminum at atmospheric pressure for a certain time.
Figure 11B:
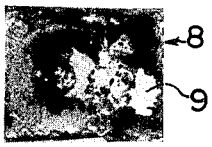
FIG. 11*b* is a photograph of a cross section cut through the end blob 8 of solidified aluminum which now is present within the formerly empty space near the closed case end of the stainless steel case, showing that a number of cavities have appeared within the blob.

In FIG. 11*a*, there is shown a photograph of this section. Further, in FIG. 11*b* there is shown a cross section through the end blob 8 of solidified aluminum which now was present within the formerly empty space 3 near the closed case end 21 of the stainless steel case 2. It is clear from these photographs that a number of cavities 9 had appeared within the blob 8, and in fact these cavities contained air. It is thus clear that the air which was originally present between the fibers of the cuboid of reinforcing fiber 1 was displaced by the flowing of the molten aluminum 15 through the inside of the stainless steel case 2, from its open case end 22 towards its closed case end 21, and that this air was swept into the empty space 3 at the closed case end 21, of course in highly compressed form due to the high pressure of approximately 1000 kg/cm$^2$ which was being applied, to be entrapped within the molten aluminum which accumulated in this space 3, in the form of tiny bubbles which could not have been seen in their original state. Thus, the remelting procedure as described above was necessary, in order to allow this trapped highly compressed air to expand so as to form bubbles or voids which were actually visible.

It was found, in the fourth embodiment described above, that no very large voids existed between the alumina fibers of the produced cuboid of composite alumina fiber/aluminum material. It is presumed that the air which was originally present between the fibers of the cuboid of reinforcing fiber 1 was displaced by the flowing of the molten aluminum 15 through the inside of the stainless steel case 2.

For this flowing, it is considered that the preheating of the stainless steel case 2 charged with the alumina reinforcing fiber 1 to a temperature substantially higher than the melting point of the aluminum matrix metal was absolutely essential, because otherwise the flowing aluminum matrix metal would have tended to solidify as it flowed between the alumina fibers of the bundle of alumina reinforcing fiber 1 charged within the stainless steel case 2, partly due to the high packing density of said alumina reinforcing fiber 1, and thus the free flowing of the aluminum matrix metal between the alumina fibers would have been prevented, causing substantial bubbles or voids to be formed in the resulting composite material. Such preheating should be carried out to a temperature substantially higher than the melting point of the aluminum matrix metal, in order properly to fulfil its function.

Further, it is presumed that the pressure applied to the upper free surface of the mass of molten aluminum 15 by the pressure plunger 6 was important for forcing the molten aluminum matrix metal to flow between the alumina fibers of the alumina fiber bundle 1. If no such pressure had been applied, it is not considered that a good composite material would have been produced. The fact that this pressure was high, of an order of 1000 $kg/cm^2$, is also considered to have been important. In this connection, it is considered that it was advantageous for the orientation of the fibers of the bundle of alumina reinforcing fiber 1 to have been generally in the direction along the central axis of the stainless steel case 2, because according to this orientation the molten aluminum matrix metal could more freely flow along said central axis.

Thus, again, according to the method described above, the air which was originally present between the fibers of the bundle of alumina reinforcing fiber 1 did not subsequently very much impede the good contacting together of the molten aluminum matrix metal and of the alumina fibers of the bundle of alumina reinforcing fiber 1. Thus the same functional effect was provided, in this fourth embodiment of the method for producing composite material according to the present invention, as was provided by the vacuum used in the prior art methods described above, i.e. it was prevented that atmospheric air trapped between the fibers of the bundle of alumina reinforcing fiber 1 should impede the infiltration of the molten aluminum matrix metal therebetween, even though the density of the reinforcing fiber mass 1 was relatively high; and this effect was provided without the need for provision of any vacuum device.

In the shown first, second, and third preferred embodiments of the method for producing composite material according to the present invention, the empty space 3, or air chamber, was provided by a simple vacant part of the stainless steel case 2 being left between the closed case end 21 thereof and the end of the bundle of fibers adjacent thereto; but this form of layout is not the only one possible. For example, it would be possible to provide a separate air chamber, communicated to a part of the case 2 which was remote from an open part such as 22 thereof, and, provided that the bundle 1 of reinforcing fibers was between said air chamber and said open part of the case, and intercepted communication between said open part of said case and said air chamber, the same functional effect would be available, as in the shown first, second, and third embodiments.

It has been reported that the tensile strength of a piece of alumina fiber and aluminum alloy composite material (of fiber volumetric ratio of 50% at a fiber orientation angle of zero degrees) as made by a Dupont process was about 60 $kg/mm^2$; but, if account is taken of the fact that in that case the matrix material was not pure aluminum but was an aluminum alloy, it is estimated by the present inventors that the method according to the present invention of forming composite material out of alumina fiber and aluminum is at least as effective as the Dupont method, and is capable of forming equally good composite material, despite the fact that in the method according to the present invention no vacuum is required.

THE FIFTH EMBODIMENT

Figure 12:
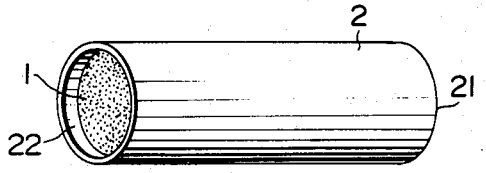
FIG. 12 is a schematic perspective view, showing a cylindrical tubular shaped stainless steel case and a bundle of reinforcing carbon fiber charged therein, which are elements involved in the practicing of a fifth preferred embodiment of the method for producing composite material according to the present invention.
Figure 13:
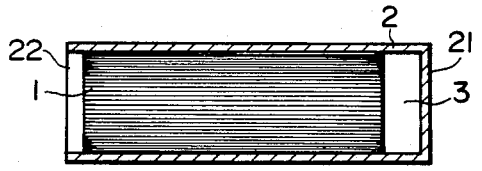
FIG. 13 is a sectional view of the elements shown in FIG. 12, taken along a generally vertical plane extending in the longitudinal direction of the stainless steel case through the central portion thereof, for showing an empty space left between the carbon fiber bundle and the closed end of the case.
Figure 14:
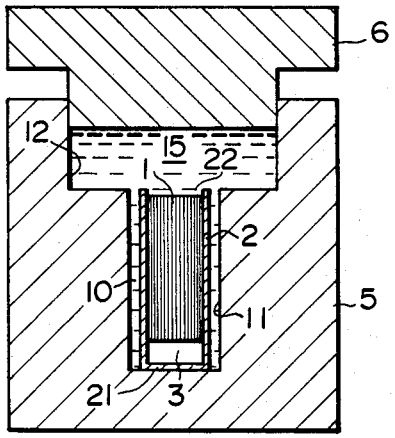
FIG. 14 is a sectional view, taken along a plane approximately the same as that of the section shown in FIG. 13, showing the tubular cylindrical stainless steel case with the carbon fiber bundle charged therein as placed in the cavity of a casting mold 5 which is charged with molten matrix metal, and as supported on its closed end therein with a space left around its sides, and also showing a pressure plunger fitted into the upper part of the casting mold with which said plunger cooperates, for pressurizing the free upper surface of the molten matrix metal.

FIG. 12 is a schematic perspective view, and FIGS. 13 and 14 are sectional views, showing elements involved in the practicing of a fifth preferred embodiment. The particular meaning of this embodiment is as follows: first, the case supports 4 are dispensed with, and instead the stainless steel case 2 is stood within the casting mold 5 with a space left between the sides of the stainless steel case 2 and the sides of the casting mold 5, in order to provide heat insulation therebetween to stop the case 2 being cooled down and losing its preheating temperature to the casting mold 5 which is preheated to a much lower temperature; second, a different combination of materials, i.e. carbon reinforcing fiber and aluminum matrix metal, is used. The production of fiber reinforced material, in this fifth preferred embodiment, was carried out as follows.

A cylindrical tubular stainless steel case 2 was formed of stainless steel of JIS (Japanese Industrial Standard) SUS310S, and was 90 mm long, 26 mm in diameter, and 1 mm thick. This stainless steel case 2 was formed with one closed case end 21 and one open case end 22. The stainless steel case 2 was charged with a bundle of reinforcing fiber 1, which in this fifth preferred embodiment was so called Torayca M40 type high elastic modulus carbon fiber made by Toray Co. Ltd. Said bundle of carbon reinforcing fiber 1 was 80 mm long, and the fibers of said bundle of carbon reinforcing fiber 1 were all aligned with substantially the same fiber orientation and were 7 microns in diameter. This charging of the stainless steel case 2 was performed in such a way that an empty space 3 was left between the closed case end 21 and the end of the bundle of carbon reinforcing fiber 1 adjacent thereto. The bundle of carbon reinforcing fiber 1 was squeezed by the stainless steel case 2 by such an amount that its volume ratio was approximately 65%; i.e. so that the proportion of the total volume of the bundle of carbon reinforcing fiber 1 actually occupied by carbon fiber was approximately 65%, the rest of this volume of course at this initial stage being occupied by atmospheric air. Further, in the shown fifth preferred embodiment, the orientation of the fibers of the bundle of carbon reinforcing fiber 1 was in the direction along the central axis of the stainless steel case 2.

Next, the stainless steel case 2 charged with the carbon reinforcing fiber 1 was preheated up to a temperature substantially higher than the melting point of the matrix metal which it was intended to use for commingling with said reinforcing fiber 1. In this fifth preferred embodiment, in which the intended matrix metal was aluminum metal, the stainless steel case 2 charged with carbon reinforcing fiber 1 was heated up to 900° C., which was a temperature substantially higher than 660° C., which is the melting point of aluminum metal.

Next, the heated stainless steel case 2 charged with the carbon reinforcing fiber 1 was placed into a casting mold 5, so that the stainless steel case 2 was supported on its closed case end 21, i.e. on its end within which the empty space 3 was left, and so that the sides of said stainless steel case 2 did not touch the inner walls 11 of said casting mold 5. In other words, a heat insulating space 10 was left between the outer cylindrical surface of said cylindrical stainless steel case 2 and the inner walls 11 of said casting mold 5. At this time the casting mold 5 was preheated to a temperature of 300° C., in this fifth preferred embodiment. Because this mold preheat temperature of 300° C. was very much lower than the above mentioned case and reinforcing fiber preheat temperature of 900° C., if such a heat insulating space 10 had not been left between the outer cylindrical surface of said cylindrical stainless steel case 2 and the inner walls 11 of said casting mold 5, the cylindrical stainless steel case 2 and the carbon reinforcing fiber bundle 1 charged therein would almost immediately have been cooled down by contact with the casting mold 5, and the practice of the process according to the present invention would have been impossible.

Further, the fact that the empty space 3, containing at this time atmospheric air, was located at the bottom of the stainless steel case 2 as it rested within the casting mold 5, i.e. at that part of the stainless steel case 2 which contacted the casting mold 5, meant that the loss of the preheating heat from the bundle of reinforcing carbon fiber 1 to the casting mold was further impeded. This is a very useful specialization of the present invention.

Next, a quantity of molten aluminum 15 at a temperature of approximately 850° C. (substantially above the melting point of aluminum, which is 660° C.) was poured briskly into the casting mold 5, so that the stainless steel case 2 charged with the carbon reinforcing fiber 1, still at substantially its aforesaid preheat temperature of 900° C. because of the provision of the heat insulating space 10, was submerged below the surface of said quantity of molten aluminum 15 contained in the casting mold 5. The upper free surface of the mass of molten aluminum 15 was then pressurized by a pressure plunger 6, which was forced into an upper part of the casting mold 5 with which said pressure plunger 6 cooperated closely, to a high pressure of approximately 1000 kg/cm$^2$. The pressure plunger 6 was previously preheated to approximately 200° C. The stainless steel case 2 charged with the carbon reinforcing fiber 1 was kept in this submerged condition under the molten aluminum 15 for a certain time, and during this time the molten aluminum 15 was gradually allowed to cool until said aluminum 15 all became completely solidified. The aforesaid high pressure of approximately 1000 kg/cm$^2$ was maintained during all this cooling period, until complete solidification of the mass of molten aluminum 15.

Finally, the stainless steel case 2 was removed by machining or the like from around the bundle of carbon reinforcing fiber 1, which had now become thoroughly infiltrated with the aluminum metal to form a cylinder of composite carbon fiber/aluminum material. It was found, in the fifth preferred embodiment described above, that substantially no voids existed between the fibers of this cylinder of composite carbon fiber/aluminum material, while an end blob of aluminum had become solidified in the formerly empty space 3 within the stainless steel case 2 near its closed case end 21. This end blob could of course have been removed and thrown away or recycled. It is presumed that the air which was originally present between the fibers of the cylinder of reinforcing fiber 1 was displaced by the flowing of the molten aluminum 15 through the inside of the stainless steel case 2 from its open case end 22 towards its closed case end 21, and that this air was swept into the empty space 3 at the closed case end 21, and was therein compressed into very small bubbles which could not be seen in the resulting blob of aluminum, mentioned above.

For this flowing, it is considered that the preheating of the stainless steel case 2 charged with the carbon reinforcing fiber 1 to a temperature substantially higher than the melting point of the aluminum matrix metal was absolutely essential, because otherwise the flowing aluminum matrix metal would have tended to solidify as it flowed between the carbon fibers of the bundle of carbon reinforcing fiber 1 charged within the stainless steel case 2, partly due to the high packing density of said carbon reinforcing fiber 1, and thus the free flowing of the aluminum matrix metal between the carbon fibers would have been prevented, causing bubbles or voids to be formed in the resulting composite material. Such preheating should be carried out to a temperature substantially higher than the melting point of the aluminum matrix metal, in order properly to fulfil its function.

At this time, the action of the stainless steel case 2 for maintaining the desired shape of the bundle 1 of reinforcing carbon fibers was very important. If no case such as the stainless steel case 2 were provided, then the mass of reinforcing carbon fibers 1 would have tended to get out of shape, and also the density and orientation of these carbon fibers would have been disturbed, during the pouring of the molten aluminum matrix metal thereonto; and thereby the quality of the resulting carbon fiber/aluminum composite material formed would have been deteriorated.

Further, it is presumed that the pressure applied to the upper free surface of the mass of molten aluminum 15 by the pressure plunger 6 was important for forcing the molten aluminum matrix metal to flow between the carbon fibers of the carbon fiber bundle 1. If no such pressure had been applied, it is not considered that a good composite material would have been produced. The fact that this pressure was high, of an order of 1000 kg/cm$^2$, is considered to be important.

Yet further, it is presumed that the provision of the empty space 3 was substantially helpful, in addition, for aiding the smooth passing of the molten matrix metal into and through the interstices of the bundle of carbon reinforcing fiber 1, because the bundle of carbon reinforcing fiber 1 was located between the empty space 3 and the open case end 22 of the stainless steel case 2, and thus intercepted passage of molten matrix metal from said open case end 22 to fill said empty space 3. In other words, said space 3 provided a kind of sink toward which the air existing in the interstices of the porous structure of the reinforcing carbon fiber mass 1 could escape, as the molten matrix metal was charged into and through the interstices of the porous structure of the reinforcing carbon fiber mass 1 from said opening of said case 2. In this connection, it was advantageous for the orientation of the fibers of the bundle of carbon reinforcing fiber 1 to be generally in the direction along the central axis of the stainless steel case 2, because according to this orientation the molten aluminum matrix metal could more freely flow along said central axis, from said open case end 22 of said stainless steel case 2 towards said empty space 3 at the closed case end 21 thereof.

Thus, according to the method described, the air which was originally present between the fibers of the bundle of carbon reinforcing fiber did not subsequently impede the good contacting together of the molten aluminum matrix metal and of the crbon fibers of the bundle of carbon reinforcing fiber 1. Thus the same functional effect was provided, in this fifth preferred embodiment, as was provided by the vacuum used in the prior art methods described above, i.e. it was prevented that atmospheric air trapped between the fibers of the bundle of carbon reinforcing fiber 1 should impede the infiltration of the molten aluminum matrix metal therebetween, even though the density of the reinforcing fiber mass 1 was relatively high; and this effect was provided without the need for provision of any vacuum device.

When a tensile strength test was performed upon such a piece of composite carbon fiber/aluminum material made in such a way as described above, at 0° fiber orientation, a tensile strength of 70 kg/mm$^2$ to 90 kg/mm$^2$ was recorded. This is better than the tensile strength of an carbon fiber/aluminum composite material which has been made by either of the above described inefficient conventional methods, i.e. the diffusion adhesion method or the autoclave method; in these conventional methods a typical strength of the resulting carbon fiber/aluminum composite material produced is about 60 kg/mm$^2$.

Further, on microscopic examination of various cross sections of the carbon fiber/aluminum composite material made according to this fifth preferred embodiment, the following facts were observed: first, no substantial irregularities in the orientation of the carbon fibers had been caused by the infiltration of the aluminum matrix metal thereinto, and the orientation of substantially all of these carbon fibers was still along the central axis of the cylindrical stainless steel case 2; second, no substantial oxidization degeneration of the reinforcing carbon fibers had occurred due to the preheating; third, the volumetric ratio of the carbon fibers of approximately 65% before the infiltration of the molten aluminum matrix metal thereinto was preserved in the resulting carbon fiber/aluminum composite material.

Next, again a stainless steel case 2 was charged with a bundle of reinforcing carbon fiber 1 so that an empty space 3 was left between a closed case end 21 of the case 2 and an end of the reinforcing carbon fiber bundle 1, in a fashion identical to that performed in the shown fifth preferred embodiment, and again as outlined above molten aluminum was poured around the case 2 and was pressurized to a high pressure of approximately 1000 kg/cm$^2$, until it solidified. Next, however, after the solidified aluminum had been removed from around the stainless steel case 2, the stainless steel case 2 with the resulting composite carbon fiber/aluminum material produced according to the fifth preferred embodiment still charged within it was again submerged in molten aluminum, for a few minutes, without any pressure other than atmospheric pressure being applied thereto. Then, after this stainless steel case 2 and the bundle of reinforcing carbon fiber 1 now infiltrated with aluminum therein were removed from this molten aluminum, and after they had cooled, a longitudinal section was cut through them. It was found that a number of cavities were visible within the blob of aluminum which was now present within the formerly empty space 3, and in fact these cavities contained air. It is thus clear that the air which was originally present between the fibers of the cylinder of reinforcing carbon fiber 1 was displaced by the flowing of the molten aluminum 15 through the inside of the stainless steel case 2, from its open case end 22 towards its closed case end 21, and that this air was swept into the empty space 3 at the closed case end 21, of course in highly compressed form due to the high pressure of approximately 1000 kg/cm$^2$ which was being applied, to be entrapped within the molten aluminum which accumulated in this space 3, in the form of tiny bubbles which could not be seen in their original state. Thus, the remelting procedure as described above was necessary, in order to allow this trapped highly compressed air to expand so as to form bubbles or voids which were actually visible.

The use of the stainless steel case 2 was of course helpful for maintaining the shape of the bundle 1 of reinforcing carbon fiber, and for maintaining the orientation of these carbon fibers during the infiltration process. Further, as explained above, because the heat insulating space 10 was left between the outer cylindrical surface of said cylindrical stainless steel case 2 and the inner walls 11 of said casting mold 5, thereby it was prevented that the cylindrical stainless steel case 2 and the carbon reinforcing fiber bundle 1 charged therein should quickly be cooled down by contact with the casting mold 5, before pouring of the molten aluminum mass 15 thereinto. Thereby, the practice of the process according to the present invention became possible. Further, because the empty space 3, containing initially atmospheric air, was located at the bottom of the stainless steel case 2 as it rests within the casting mold 5, i.e. was located at the lower part of the stainless steel case 2 which contacts the casting mold 5, therefore the loss of the preheating heat from the bundle of reinforcing carbon fiber 1 to the casting mold was made difficult.

As a matter of course, it was preferable to make the case 2 out of a material which did not dissolve into the matrix metal when the molten matrix metal was poured thereonto.

THE SIXTH EMBODIMENT

Figure 15:
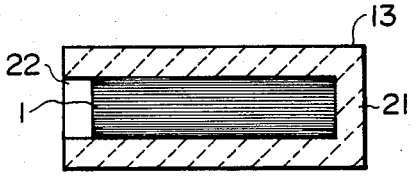
FIG. 15 is a sectional view, similar to FIG. 2, of elements involved in the practice of a sixth preferred embodiment of the method for producing composite material according to the present invention, taken along a generally vertical plane extending in the longitudinal direction of a refractory brick case through the central portion thereof, said refractory brick case being charged with a quantity of stainless steel fiber.
Figure 16:
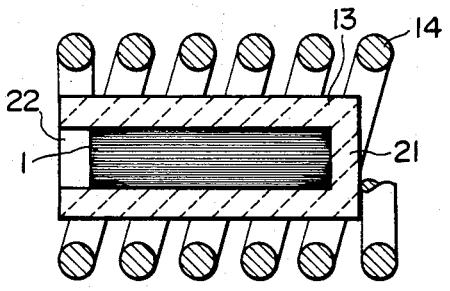
FIG. 16 is a sectional view, similar to FIG. 15, but also showing a high frequency induction coil fitted around the refractory brick case, for heating said stainless steel fiber charged therein without substantially heating said refractory brick case.
Figure 17:
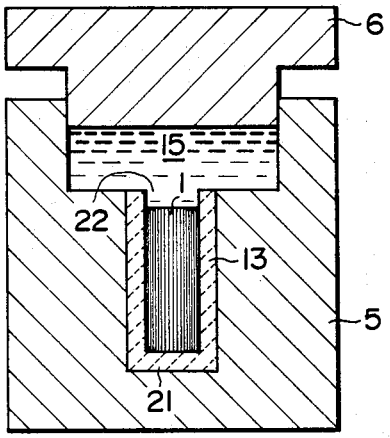
FIG. 17 is a sectional view, similar to FIG. 3, but relating to this sixth preferred embodiment of the method for producing composite material according to the present invention, showing the tubular cylindrical refractory brick case with the stainless steel reinforcing fiber bundle charged therein as placed in the cavity of a casting mold 5 which is charged with molten aluminum matrix metal, and as supported on its closed end therein with no space left around its sides, and also showing a pressure plunger fitted into an upper part of the casting mold with which said plunger cooperates, for pressurizing the free upper surface of the molten aluminum matrix metal.

FIGS. 15, 16, and 17 are sectional views, similar respectively to FIG. 2, FIG. 2, and FIG. 3, showing elements involved in the practicing of a sixth preferred embodiment. The particular meaning of this embodiment is as follows: first, the stainless steel case 2 of the first through fifth preferred embodiments previously shown is dispensed with, and instead the reinforcing fiber bundle 1 is charged within a refractory brick case 13, which is stood within the casting mold 5 with no particular space left between the sides of the refractory brick case 13 and the sides of the casting mold 5, this arrangement being acceptable because the refractory brick case 13 has such a heat insulation characteristic which provides a good heat insulation function between the reinforcing fiber bundle 1 and the casting mold 5, so as to stop the reinforcing fiber bundle 1 from being cooled down and from losing its preheating temperature to the casting mold 5 which is preheated to a much lower temperature; second, a different combination of materials, i.e. stainless steel reinforcing fiber and aluminum matrix metal, is used. The production of fiber reinforced material, in this sixth preferred embodiment, was carried out as follows.

A cylindrical tubular case 13 was formed of porous refractory brick of JIS (Japanese Industrial Standard) B2, and was 90 mm long, 24 mm in inner diameter, and 10 mm in wall thickness. Other possible materials for such a refractory brick case, in other embodiments, could be alumina, silicon nitride, graphite, or other kinds of mortar, ceramic, or cement. This refractory brick case 13 was formed with one closed case end 21 and one open case end 22. The refractory brick case 13, as seen in FIG. 15, was charged with a bundle of reinforcing fiber 1, which in this sixth preferred embodiment was stainless steel fiber of JIS (Japanese Industrial Standard) SUS304. Said bundle of stainless steel reinforcing fiber 1 was 80 mm long, and the fibers of said bundle of stainless steel reinforcing fiber 1 were all aligned with substantially the same fiber orientation and were 12 microns in diameter. This charging of the refractory brick case 13 was performed in such a way that no empty space such as the empty space 3 of some of the previous preferred embodiments of the method for producing composite material according to the present invention was left between the closed case end 21 and the end of the bundle of stainless steel reinforcing fiber 1 adjacent thereto; i.e., the end of the bundle of stainless steel reinforcing fiber 1 near the closed case end 21 of the refractory brick case 13 closely touched said closed case end 21. The bundle 1 of stainless steel reinforcing fiber was squeezed by the refractory brick case 13 by such an amount that its volume ratio was approximately 50%; i.e. so that the proportion of the total volume of the bundle 1 of stainless steel reinforcing fiber actually occupied by stainless steel fiber was approximately 50%, the rest of this volume of course at this initial stage being occupied by atmospheric air. Further, in the shown sixth preferred embodiment of the method for producing composite material according to the present invention, the orientation of the fibers of the bundle 1 of stainless steel reinforcing fiber was in the direction along the central axis of the refractory brick case 13.

Next, the stainless steel reinforcing fiber 1 charged into the refractory brick case 13 was preheated up to a temperature substantially higher than the melting point of the matrix metal which it was intended to use for commingling with said stainless steel reinforcing fiber 1. In this sixth peferred embodiment, in which the intended matrix metal was aluminum metal, the stainless steel reinforcing fiber 1 charged into the refractory brick case 13 was heated up to 700° C., which was a temperature substantially higher than 660° C., which is the melting point of aluminum metal. This heating was performed by an induction coil 14 of a high frequency heating device, which was temporarily fitted around the refractory brick case 13, as can best be seen in FIG. 16. Therefore, the refractory brick case 13, which was of course formed of an electrically insulating material, was not substantially heated up, and accordingly said refractory brick case 13 remained quite cool, since, because said refractory brick case 13 possessed a good heat insulating characteristic, the heat communicated to the stainless steel reinforcing fiber bundle 1 was not substantially conducted away therefrom to the material of said refractory brick case 13.

Next, the refractory brick case 13 charged with the preheated stainless steel reinforcing fiber 1 was placed into a casting mold 5, as may be seen in FIG. 17, so that the refractory brick case 13 was supported on its closed case end 21, and so that the sides of said refractory brick case 13 touched the inner walls of said casting mold 5. In other words, no particular vacant space was left between the outer cylindrical surface of said cylindrical refractory brick case 13 and the inner walls of said casting mold 5. At this time the casting mold 5 was preheated to a temperature of 300° C., in this sixth preferred embodiment. Because this mold preheat temperature of 300° C. was very much lower than the above mentioned reinforcing fiber preheat temperature of 700° C., if the refractory brick case 13 had not had a good heat insulating capacity, then undesirably the stainless steel reinforcing fiber bundle 1 charged in the refractory brick case 13 would almost immediately have been cooled down by the contact of the refractory brick case 13 with the casting mold 5, and the practice of the process according to the present invention would have been impossible.

Next, a quantity of molten aluminum 15 at a temperature of approximately 850° C. (substantially above the melting point of aluminum, which is 660° C.) was poured briskly into the upper part of the casting mold 5, so that the upper part of the refractory brick case 13 charged with the stainless steel reinforcing fiber 1, said bundle 1 of stainless steel reinforcing fiber still being at substantially its aforesaid preheat temperature of 700° C. because of the heat insulating characteristic of the refractory brick case 13, was submerged below the surface of said quantity of molten aluminum 15 contained in the upper part of the casting mold 5. The upper free surface of the mass of molten aluminum 15 was then pressurized by a pressure plunger 6, which was forced into an upper part of the casting mold 5 with which said pressure plunger 6 cooperated closely, to a high pressure of approximately 1000 kg/cm$^2$. The pressure plunger 6 was previously preheated to approximately 200° C. The refractory brick case 13 charged with the stainless steel reinforcing fiber 1 was kept in this submerged condition under the molten aluminum 15 for a certain time, and during this time the molten aluminum 15 was gradually allowed to cool until said aluminum 15 all became completely solidified. The aforesaid high pressure of approximately 1000 kg/cm$^2$ was maintained during all this cooling period, until complete solidification of the mass of molten aluminum 15.

Finally, the refractory brick case 13 was removed from the casting mold 5, and was broken up from around the bundle of stainless steel reinforcing fiber 1, which had now become thoroughly infiltrated with the aluminum metal to form a cylinder of composite stainless steel fiber/aluminum material. It was found that this breaking up was relatively easy, and upon examination it was confirmed that virtually no aluminum had infiltrated into the pores of the refractory brick case 13. Then the excess aluminum adhering to this cylinder of composite stainless steel fiber/aluminum material was machined away. It was found, in the sixth preferred embodiment described above, that substantially no voids existed between the fibers of this cylinder of composite stainless steel fiber/aluminum material. It is presumed that the air which was originally present between the fibers of the cylinder of reinforcing fiber 1 was displaced by the flowing of the molten aluminum 15 through the inside of the refractory brick case 13 from its open case end 22 towards its closed case end 21, and that this air was swept into the empty porous structure of the refractory brick case 13, and was therein compressed into very small bubbles which could not be seen in the resulting fragments of broken brick case.

For this flowing, it is considered that the preheating of the stainless steel reinforcing fiber 1 charged into the refractory brick case 13 to a temperature substantially higher than the melting point of the aluminum matrix metal was absolutely essential, because otherwise the flowing aluminum matrix metal would have tended to solidify as it flowed between the stainless steel fibers of the bundle 1 of stainless steel reinforcing fiber charged within the refractory brick case 13, partly due to the high packing density of said stainless steel reinforcing fiber 1, and thus the free flowing of the aluminum matrix metal between the stainless steel fibers would have been prevented, causing bubbles or voids to be formed in the resulting composite material. Such preheating should be carried out to a temperature substantially higher than the melting point of the aluminum matrix metal, in order properly to fulfil its function.

At this time, the action of the refractory brick case 13 for maintaining the desired shape of the bundle 1 of reinforcing stainless steel fibers was very important. If no case such as the refractory brick case 13 were provided, then the mass of reinforcing stainless steel fibers 1 would have tended to get out of shape, and also the density and orientation of these stainless steel fibers would have been disturbed, during the pouring of the molten aluminum matrix metal thereonto; and thereby the quality of the resulting stainless steel fiber-/aluminum composite material formed would have been deteriorated.

Further, it is presumed that the pressure applied to the upper free surface of the mass of molten aluminum 15 by the pressure plunger 6 was important for forcing the molten aluminum matrix metal to flow between the stainless steel fibers of the stainless steel fiber bundle 1. If no such pressure had been applied, it is not considered that a good composite material would have been produced. The fact that this pressure was high, of an order of 1000 kg/cm$^2$, is considered to have been important. Further, it is though to have been advantageous for the orientation of the fibers of the bundle of stainless steel reinforcing fiber 1 to have been generally in the direction along the central axis of the refractory brick case 13, because according to this orientation the molten aluminum matrix metal was more freely able to flow along said central axis, from said open case end 22 of said refractory brick case 13 towards the closed case end 21 thereof.

Thus, according to the method described, the air which was originally present between the fibers of the bundle of stainless steel reinforcing fiber 1 did not subsequently impede the good contacting together of the molten aluminum matrix metal and of the stainless steel fibers of the bundle of stainless steel reinforcing fiber 1. Thus the same functional effect was provided, in this sixth preferred embodiment, as was provided by the vacuum used in the conventional prior art methods described above, i.e. it was prevented that atmospheric air trapped between the fibers of the bundle of stainless steel reinforcing fiber 1 should impede the infiltration of the molten aluminum matrix metal therebetween, even though the density of the reinforcing mass 1 of fibers was relatively high; and this effect was provided without the need for provision of any vacuum device.

When a tensile strength test was performed upon such a piece of composite stainless steel fiber/aluminum material made in such a way as described above, at 0° fiber orientation, a tensile strength of 60 kg/mm$^2$ was recorded. This is quite comparable to the tensile strength of a stainless steel fiber/aluminum composite material which has been made by either of the above described inefficient conventional methods, i.e. the diffusion adhesion method or the autoclave method.

The use of the refractory brick case 13 was of course helpful for maintaining the shape of the bundle 1 of reinforcing stainless steel fiber, and for maintaining the packing density and orientation of these stainless steel fibers during the infiltration process. Further, as explained above, because the cylindrical refractory brick case 13 had a good heat insulating characteristic, thereby it was prevented that the stainless steel reinforcing fiber bundle 1 charged therein should quickly be cooled down by conduction of heat from said stainless steel reinforcing fiber bundle 1 to the casting mold 5, before pouring of the molten aluminum mass 15 into said casting mold 5, even though no space was provided between the outer wall of the refractory brick case 13 and the inner wall of the casting mold 5. Thereby, the practice of the process according to the present invention became possible. The elimination of this space between the outer wall of the refractory brick case 13 and the inner wall of the casting mold 5, which was present in the other preferred embodiments, previously shown, of the method for producing composite material according to the present invention, has the advantage that molten aluminum does not uselessly solidify within such a space, and accordingly the removal of excess solidified aluminum from the cylinder of composite stainless steel fiber/aluminum material produced in much easier than in the previously shown embodiments.

Further, in a variant embodiment, it would be possible additionally to provide an empty space 3, initially containing atmospheric air, as located at the bottom of the refractory brick case 13 as it rests within the casting mold 5, i.e. located at the closed case end 21 of the refractory brick case 13, between said closed case end 21 and the bundle 1 of reinforcing stainless steel fibers, as in some of the previously shown preferred embodiments of the present invention; and such an empty space 3 would function as in those previously described embodiments to aid in the accomodation of the air which was originally present between the stainless steel fibers of the bundle 1.

An advantage which accrued from the use of a high frequency induction coil such as the induction coil 14 for heating the stainless steel fiber bundle 1 charged within the refractory brick case 2 was that, since thereby the refractory brick case 2 was not particularly heated up, therefore, during the process of pressure infiltration of the molten aluminum matrix metal into the porous structure of the bundle 1 of stainless steel reinforcing fibers, the occurrence of penetration of this molten aluminum under pressure into the porous structure of the refractory brick case 2 was almost completely obviated. Thereby, there was no substantial risk of this aluminum strengthening the refractory brick case 2 to such a degree as to make it difficult to break away said refractory brick case 2 from around the cylinder of composite stainless steel fiber/aluminum material produced.

THE SEVENTH EMBODIMENT

Figure 18:
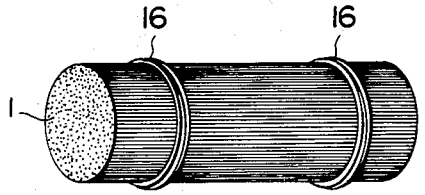
FIG. 18 is a schematic perspective view, showing a cylindrical shaped bundle of reinforcing fiber, and two wire ties fastened therearound, which are elements involved in the practicing of a seventh preferred embodiment of the method for producing composite material according to the present invention.
Figure 19:
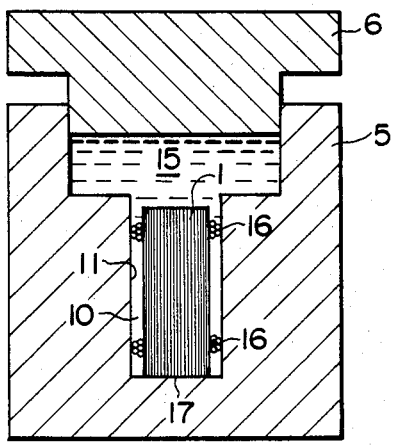
FIG. 19 is a sectional view, similar to FIG. 2, of said reinforcing fiber bundle, a casting mold, a pressure plunger, and other elements involved in the practice of said seventh preferred embodiment of the method for producing composite material according to the present invention, taken along a generally vertical plane extending in the longitudinal direction of said reinforcing fiber bundle through the central portion thereof, said fiber bundle being fitted into a cavity formed in said casting mold.

FIG. 18 is a schematic perspective view, and FIG. 19 is a sectional view, showing elements involved in the practicing of a seventh preferred embodiment. The particular meaning of this seventh preferred embodiment is as follows: first, the case 2 of the first through sixth preferred embodiments shown above is dispensed with, and instead two pieces of stainless steel wire 16 are wrapped around the bundle 1 of reinforcing material so as to form a tied reinforcing fiber bundle which is preheated and is stood up within the casting mold 5 with a space left between the circumferentially outer parts of of the fiber bundle 1 and the sides of the casting mold 5, in order to provide heat insulation therebetween so as to stop the fiber bundle 1 being cooled down and losing its preheating temperature to said casting mold 5 which is preheated to a much lower temperature; second, the combination of materials of alumina reinforcing fiber and aluminum matrix metal is used. The production of fiber reinforced material, in this seventh preferred embodiment, was carried out as follows.

Two quite long pieces of cylindrical stainless steel wire 16 were formed of stainless steel of JIS (Japanese Industrial Standard) SUS310S, and were 0.3 mm in diameter. These two pieces of stainless steel wire 16 were tied around a bundle of reinforcing fiber 1, which in this seventh preferred embodiment was so called FP alumina fiber made by Dupont. Said bundle of alumina reinforcing fiber 1 was 80 mm long, and the fibers of said bundle of alumina reinforcing fiber 1 were all aligned with substantially the same fiber orientation and were 20 microns in diameter. This tying of the two pieces of stainless steel wire 16 was performed at places about 15 mm away from the ends of the bundle of alumina reinforcing fiber 1, i.e. at two places about 50 mm apart from one another, each about 25 mm from the center of the bundle 1. The bundle 1 of alumina reinforcing fiber was squeezed by the two pieces of stainless steel wire 16 by such an amount that its volume ratio was approximately 50%; i.e. so that the proportion of the total volume of the bundle of alumina reinforcing fiber 1 actually occupied by alumina fiber was approximately 50%, the rest of this volume of course at this initial stage being occupied by atmospheric air. Further, in the shown seventh preferred embodiment, the orientation of the fibers of the bundle of alumina reinforcing fiber 1 was in the direction along the central axis of the bundle 1, and also the bundle 1 was formed into a roughly cylindrical shape.

Next, the bundle of alumina reinforcing fiber 1 with the stainless steel wire 16 tied therearound was preheated up to a temperature substantially higher than the melting point of the matrix metal which it was intended to use for commingling with said reinforcing fiber 1. In this seventh preferred embodiment, in which the intended matrix metal was aluminum metal, the bundle of alumina reinforcing fiber 1 with the stainless steel wire 16 tied therearound was heated up to 900° C., which was a temperature substantially higher than 660° C., which is the melting point of aluminum metal.

Next, the heated bundle of alumina reinforcing fiber 1 with the stainless steel wire 16 tied therearound was placed into a casting mold 5, so that the bundle 1 was supported on one of its ends on the bottom of the casting mold 5, and so that the outer sides of the two wrapped around stainless steel wires 16 touched the inner walls 11 of said casting mold 5, but so that the outer peripheral part of the alumina fiber bundle 1 did not touch said inner walls 11. In other words, a heat insulating space 10 was left between the outer cylindrical surface of said roughly cylindrical alumina fiber bundle 1 and the inner walls 11 of said casting mold 5, and the alumina fiber bundle 1 was supported within the casting mold 5 by the pressure of the sides of said two wrapped around stainless steel wires 16 pressing against the inner walls 11 of said casting mold 5. At this time the casting mold 5 was preheated to a temperature of 300° C., in this seventh preferred embodiment. Because this mold preheat temperature of 300° C. was very much lower than the above mentioned stainless steel wire and reinforcing fiber preheat temperature of 900° C., if such a heat insulating space 10 had not been left between the outer cylindrical surface of said cylindrical bundle of reinforcing fiber 1 and the inner walls 11 of said casting mold 5, the cylindrical alumina reinforcing fiber bundle 1 would almost immediately have been cooled down by contact with the casting mold 5, and the practice of the process according to the present invention would have been impossible.

Next, a quantity of molten aluminum 15 at a temperature of approximately 850° C. (substantially above the melting point of aluminum, which is 660° C.) was poured briskly into the casting mold 5, so that the bundle of alumina reinforcing fiber 1 with the two stainless steel wires 16 tied therearound, said fiber bundle 1 being still at substantially its aforesaid preheat temperature of 900° C. because of the provision of the heat insulating space 10, was submerged below the surface of said quantity of molten aluminum 15 contained in the casting mold 5. The upper free surface of the mass of molten aluminum 15 was then pressurized by a pressure plunger 6, which was forced into an upper part of the casting mold 5 with which said pressure plunger 6 cooperated closely, to a high pressure of approximately 1000 kg/cm$^2$. The pressure plunger 6 was previously preheated to approximately 200° C. The bundle of alumina reinforcing fiber 1 with the stainless steel wire 16 tied therearound was kept in this submerged condition under the molten aluminum 15 for a certain time, and during this time the molten aluminum 15 was gradually allowed to cool until said aluminum 15 all became completely solidified. The aforesaid high pressure of approximately 1000 kg/cm$^2$ was maintained during all this cooling period, until complete solidification of the mass of molten aluminum 15.

Finally, the remnants of solidified aluminum and the two stainless steel wires 16 were removed by machining or the like from around the bundle of alumina reinforcing fiber 1, which had now become thoroughly infiltrated with the aluminum matrix metal to form a cylinder of composite alumina fiber/aluminum material. It was found, in this seventh preferred embodiment described above, that substantially no voids existed between the fibers of this cylinder of composite alumina fiber/aluminum material. It is presumed that the air which was originally present between the fibers of the cylindrical bundle 1 of reinforcing alumina fiber was displaced by the flowing of the molten aluminum 15 through the interstices between the fibers of the cylindrical bundle 1, both from the ends of the alumina reinforcing fiber bundle 1, and also to a certain limited extent through the sides thereof, which were left exposed to the molten aluminum matrix metal mass 15 by the aforesaid action of the stainless steel wires 16 in keeping the sides of said alumina reinforcing fiber bundle 1 away from the inner walls 11 of said casting mold 5.

For this flowing, it is again considered that the preheating of the bundle of alumina reinforcing fiber 1 with the stainless steel wire 16 tied therearound to a temperature substantially higher than the melting point of the aluminum matrix metal was absolutely essential, because otherwise the flowing aluminum matrix metal would have tended to solidify as it flowed between the alumina fibers of the bundle of alumina reinforcing fiber 1 with the two stainless steel wires 16 tied therearound, partly due to the high packing density of said alumina reinforcing fiber 1, and thus the free flowing of the aluminum matrix metal between the alumina fibers would have been prevented, causing bubbles or voids to be formed in the resulting composite material. Such preheating should again be carried out to a temperature substantially higher than the melting point of the aluminum matrix metal, in order properly to fulfil its function.

At this time, the action of the two stainless steel wires 16 for maintaining the desired shape of the bundle 1 of reinforcing alumina fibers was very important. If no tying means such as the stainless steel wires 16 had been provided, then the mass of reinforcing alumina fibers 1 would have tended to get out of shape, and also the density and orientation of these alumina reinforcing fibers would have been disturbed, during the pouring of the molten aluminum matrix metal thereonto; and thereby the quality of the resulting alumina fiber-/aluminum composite material formed would have been deteriorated.

Further, it is presumed that the pressure applied to the upper free surface of the mass of molten aluminum 15 by the pressure plunger 6 was important for forcing the molten aluminum matrix metal to flow between the alumina fibers of the reinforcing alumina fiber bundle 1. If no such pressure had been applied, it is not considered that a good composite material would have been produced. The fact that this pressure was high, of an order of 1000 kg/cm$^2$, is considered to have been important.

Thus, according to the method described, the air which was originally present between the fibers of the bundle of alumina reinforcing fiber 1 did not subsequently impede the good contacting together of the molten aluminum matrix metal and of the alumina fibers of the bundle of alumina reinforcing fiber 1. Thus the same functional effect was provided, in this seventh preferred embodiment, as was provided by the vacuum used in the prior art methods described above, i.e. it was prevented that atmospheric air trapped between the fibers of the bundle of alumina reinforcing fiber 1 should impede the infiltration of the molten aluminum matrix metal therebetween, even though the density of the reinforcing mass 1 of alumina fibers was relatively high; and this effect was provided without the need for provision of any vacuum device.

When a tensile strength test was performed upon such a piece of composite alumina fiber/aluminum material made in such a way as described above, according to the seventh preferred embodiment of the method for producing composite material according to the present invention, at 0° fiber orientation, a tensile strength of 55 kg/mm$^2$ to 60 kg/mm$^2$ was recorded. This is comparable to the tensile strength of an alumina fiber/aluminum composite material which has been made by either of the above described inefficient conventional methods, i.e. the diffusion adhesion method or the autoclave method.

The use of the stainless steel wire 16 was of course helpful for maintaining the shape of the bundle 1 of reinforcing alumina fiber, and for maintaining the orientation of these alumina fibers during the infiltration process. Further, as explained above, because the heat insulating space 10 was left between the outer cylindrical surface of said reinforcing alumina fiber bundle 1 and the inner walls 11 of said casting mold 5, due to the spacing action of said two pieces of stainless steel wire 16, thereby it was prevented that the cylindrical alumina reinforcing fiber bundle 1 tied thereby should quickly be cooled down by contact with the casting mold 5, before pouring of the molten aluminum mass 15 thereinto. Thereby, the practice of the process according to the present invention became possible.

A particular advantage of the shown seventh preferred embodiment of the method for producing composite material according to the present invention is that, because the two stainless steel wires 16 were not one solid piece, but were relatively flexible, and also were separated from one another, no difficulty arose with relation to the differential expansion of the bundle 1 of reinforcing alumina fibers, and the two stainless steel wires 16. In other words, as the stainless steel wires 16 and the reinforcing alumina fiber bundle 1 were heated up and cooled, both together and differentially, no problem arose of differential expansion of the two different materials thereof. Thus, because the restraining means for holding the reinforcing alumina fiber bundle 1 (i.e., the two stainless steel wires 16), in this seventh preferred embodiment, was able flexibly to follow the expanding and the contracting of said alumina fiber bundle 1 caused by heat, no problem arose due to poor cooperation between said alumina reinforcing fiber bundle 1 and its restraining means, as might possibly have been the case in the above shown other preferred embodiments of the method for producing composite material according to the present invention, which utilized a case such as the stainless steel case 2.

This particular seventh preferred embodiment of the present invention is particularly suitable for producing fiber reinforced material in pieces which are generally cylindrical in form, because of the action of the carbon binding fiber 18 in restraining the reinforcing fiber bundle 1 during the casting process, which is essentially well adapted to retaining the fiber bundle 1 in a cylindrical form, and would not be suitable for retaining it in any other form.

Further, the construction as shown above, wherein the alumina reinforcing fiber bundle 1 is supported firmly within the casting mold 5, by the outer sides of the two wrapped around stainless steel wires 16 touching the inner walls 11 of said casting mold 5, is very helpful for ensuring good and secure holding of the alumina reinforcing fiber bundle 1 during the casting process, while ensuring both that the preheating of said alumina reinforcing fiber bundle 1 is not lost to the casting mold 5, as explained above, and also that the molten aluminum matrix metal mass 15 can well get at the sides of said alumina reinforcing fiber bundle 1 to penetrate into the interstices thereof.

As a matter of course, it is preferable to make the wire 16 out of a material which does not dissolve into the matrix metal when the molten matrix metal is poured thereonto, such as stainless steel.

THE EIGHTH EMBODIMENT

Figure 20:
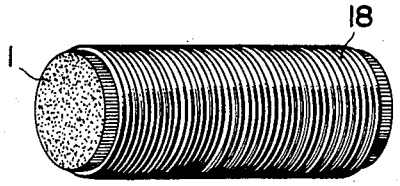
FIG. 20 is a schematic perspective view, similar to FIG. 18, showing a cylindrical shaped bundle of reinforcing fiber, and a carbon fiber wrapped therearound all along the length thereof, which are elements involved in the practicing of an eighth preferred embodiment of the method for producing composite material according to the present invention.

FIG. 20 is a schematic perspective view, showing elements involved in the practicing of a eighth preferred embodiment of the present invention. Further, FIG. 19 is applicable, mutatis mutandis, to this eighth preferred embodiment also. The particular meaning of this eighth preferred embodiment is as follows: first, the case 2 of the first through sixth preferred embodiments, described above, is dispensed with, and instead a piece of carbon binding fiber 18 is wrapped around the bundle 1 of reinforcing material so as to form a tied fiber bundle which is preheated and is stood up within the casting mold 5, with only the carbon binding fiber 18 generally in contact with the sides of the casting mold 5, in order to provide heat insulation between the bundle 1 of fiber reinforcing material and the casting mold 5, so as to stop said fiber bundle 1 being cooled down and losing its preheating temperature to the casting mold 5 which is preheated to a much lower temperature; second, the combination of materials of boron reinforcing fiber and aluminum matrix metal is used. The production of fiber reinforced material, in this eighth preferred embodiment, was carried out as follows.

A long piece of cylindrical binding carbon fiber 18, formed of carbon fiber of type Torayca T300 made by Toray Co. Ltd, was tied around a bundle of reinforcing fiber 1, which in this eighth preferred embodiment of the present invention was boron fiber made by AVCO. Said bundle of boron reinforcing fiber 1 was 80 mm long, and the fibers of said bundle of boron reinforcing fiber 1 were all aligned with substantially the same fiber orientation and were 120 microns in diameter. This tying of the piece of carbon binding fiber 18 was performed substantially all along the bundle 1 of boron reinforcing fiber, in a spiral wrapping fashion. The bundle 1 of boron reinforcing fiber was squeezed by the piece of carbon binding fiber 18 by such an amount that its volume ratio was approximately 70%; i.e. so that the proportion of the total volume of the bundle of boron reinforcing fiber 1 actually occupied by boron fiber was approximately 70%, the rest of this volume of course at this initial stage being occupied by atmospheric air. Further, in the shown eighth preferred embodiment of the present invention, the orientation of the fibers of the bundle of boron reinforcing fiber 1 was in the direction along the central axis of the bundle 1, and also the bundle 1 was formed into a roughly cylindrical shape.

Next, the bundle of boron reinforcing fiber 1 with the carbon binding fiber 18 tied therearound was preheated up to a temperature substantially higher than the melting point of the matrix metal which it was intended to use for commingling with said reinforcing fiber 1. In this eighth preferred embodiment of the present invention, in which the intended matrix metal was aluminum metal, the bundle of boron reinforcing fiber 1 with the carbon binding fiber 18 tied therearound was heated up to 900° C., which was a temperature substantially higher than 660° C., which is the melting point of aluminum metal.

Next, the thus preheated bundle of boron reinforcing fiber 1 with the carbon binding fiber 18 tied therearound was placed into a casting mold 5, so that the bundle 1 was supported on one of its ends on the bottom of the casting mold 5, and so that the outer sides of the wrapped around carbon binding fiber 18 touched the inner walls 11 of said casting mold 5, and so that thus the outer peripheral part of the boron fiber bundle 1 did not touch said inner walls 11, being insulated therefrom by the wrapped around carbon binding fiber 18 which had a fairly low heat conductivity. In other words, the carbon binding fiber 18 was interposed as a heat insulating means between the outer cylindrical surface of said roughly cylindrical boron fiber bundle 1 and the inner walls 11 of said casting mold 5, and the boron fiber bundle 1 was supported within the casting mold 5 by the pressure of the sides of said wrapped around carbon binding fiber 18 pressing against the inner walls 11 of said casting mold 5. At this time the casting mold 5 was preheated to a temperature of 300° C., in this eighth preferred embodiment of the present invention. Because this mold preheat temperature of 300° C. was very much lower than the above mentioned carbon binding fiber and reinforcing boron fiber preheat temperature of 900° C., if such a heat insulating means had not been provided between the outer cylindrical surface of said cylindrical bundle of reinforcing boron fiber 1 and the inner walls 11 of said casting mold 5, the cylindrical boron reinforcing fiber bundle 1 would almost immediately have been cooled down by contact with the casting mold 5, and the practice of the process according to the present invention would have been impossible.

Next, a quantity of molten aluminum 15 at a temperature of approximately 850° C. (substantially above the melting point of aluminum, which is 660° C.) was poured briskly into the casting mold 5, so that the bundle of boron reinforcing fiber 1 with the carbon binding fiber 18 tied therearound, said boron fiber bundle 1 being still at substantially its aforesaid preheat temperature of 900° C. because of the provision of the heat insulating carbon wrapping fiber 18, was submerged below the surface of said quantity of molten aluminum 15 contained in the casting mold 5. The upper free surface of the mass of molten aluminum 15 was then pressurized by a pressure plunger 6, which was forced into an upper part of the casting mold 5 with which said pressure plunger 6 cooperated closely, to a high pressure of approximately 1000 kg/cm$^2$. The pressure plunger 6 was previously preheated to approximately 200° C. The bundle of boron reinforcing fiber 1 with the carbon binding fiber 18 tied therearound was kept in this submerged condition under the molten aluminum 15 for a certain time, and during this time the molten aluminum 15 was gradually allowed to cool until said aluminum 15 all becomes completely solidified. The aforesaid high pressure of approximately 1000 kg/cm$^2$ was maintained during all this cooling period, until complete solidification of the mass of molten aluminum 15.

Finally, the remnants of solidified aluminum and the carbon binding fiber 18 were removed by machining or the like from around the bundle of boron reinforcing fiber 1, which had now become thoroughly infiltrated with the aluminum matrix metal to form a cylinder of composite boron fiber/aluminum material. It was found, in this eighth preferred embodiment of the present invention described above, that substantially no voids existed between the fibers of this cylinder of composite boron fiber/aluminum material. It is presumed that the air which was originally present between the fibers of the cylindrical bundle 1 of reinforcing boron fiber was displaced by the flowing of the molten aluminum 15 through the interstices between the fibers of the cylindrical bundle 1, from the ends of the boron reinforcing fiber bundle 1.

For this flowing, it is again considered that the preheating of the bundle of boron reinforcing fiber 1 with the carbon binding fiber 18 tied therearound to a temperature substantially higher than the melting point of the aluminum matrix was absolutely essential, because otherwise the flowing aluminum matrix metal would have tended to solidify as it flowed between the boron fibers of the bundle of boron reinforcing fiber 1 with the carbon binding fiber 18 tied therearound, partly due to the high packing density of said boron reinforcing fiber 1 which as stated above was as high as 70%, and thus the free flowing of the aluminum matrix metal between the boron fibers would have been prevented, causing bubbles or voids to be formed in the resulting composite material. Such preheating should again be carried out to a temperature substantially higher than the melting point of the aluminum matrix metal, in order properly to fulfil its function.

At this time, the action of the carbon binding fiber 18 for maintaining the desired shape of the bundle 1 of reinforcing boron fibers was very important. If no tying means such as the carbon binding fiber 18 had been provided, then the mass of reinforcing boron fibers 1 would have tended to get out of shape, and also the density and orientation of these boron reinforcing fibers would have been disturbed, during the pouring of the molten aluminum matrix metal thereonto and the pressurization thereof; and thereby the quality of the resulting boron fiber/aluminum composite material formed would have been deteriorated.

Further, it is again presumed that the pressure applied to the upper free surface of the mass of molten aluminum 15 by the pressure plunger 6 was important for forcing the molten aluminum matrix metal to flow between the boron fibers of the reinforcing boron fiber bundle 1. If no such pressure had been applied, it is not considered that a good composite material would have been produced. The fact that this pressure was high, of an order of 1000 kg/cm$^2$, is again considered to be important.

Thus, according to the method described, the air which was originally present between the fibers of the bundle of boron reinforcing fiber 1 did not subsequently impede the good contacting together of the molten aluminum matrix metal and of the boron fibers of the bundle of boron reinforcing fiber 1. Thus the same functional effect was provided, in this eighth preferred embodiment of the present invention, as was provided by the vacuum used in the prior art methods described above, i.e. it was prevented that atmospheric air trapped between the fibers of the bundle of boron reinforcing fiber 1 should impede the infiltration of the molten aluminum matrix metal therebetween; and this effect was provided without the need for provision of any vacuum device.

When a tensile strength test was performed upon such a piece of composite boron fiber/aluminum material made in such a way as described above, according to the eighth preferred embodiment of the present invention, at 0° fiber orientation, a tensile strength of 140 kg/mm$^2$ to 60 kg/mm$^2$ was recorded. This is very good when compared to the tensile strength of a boron fiber-/aluminum composite material which has been made by either of the above described inefficient conventional methods, i.e. the diffusion adhesion method or the autoclave method.

The use of the carbon binding fiber 18 was of course helpful for maintaining the shape of the bundle 1 of reinforcing boron fiber, and for maintaining the orientation of these boron fibers during the infiltration process. Further, as explained above, because the carbon binding fiber 18 was interposed between the outer cylindrical surface of said reinforcing boron fiber bundle 1 and the inner walls 11 of said casting mold 5, due to the heat insulating action of said piece of carbon binding fiber 18 thereby it was prevented that the cylindrical boron reinforcing fiber bundle 1 tied thereby should quickly be cooled down by contact with the casting mold 5, before pouring of the molten aluminum mass 15 thereinto. Thereby, the practice of the process according to the present invention became possible.

A particular advantage of the shown eighth preferred embodiment of the present invention is that, because the carbon binding fiber 18 was not one solid piece, but was relatively flexible, and also because the individual turns of said spirally wrapped carbon binding fiber 18 were not physically directly connected to one another, no difficulty arose with relation to the differential expansion of the bundle 1 of reinforcing boron fibers, and the carbon binding fiber 18. In other words, as the carbon binding fiber 18 and the reinforcing boron fiber bundle 1 were heated up and cooled, both together and differentially, no problem arose of differential expansion of the two different materials thereof. Thus, because the restraining means for holding the reinforcing boron fiber bundle 1 (i.e., the carbon binding fiber 18), in this eighth preferred embodiment, was able flexibly to follow the expanding and the contracting of said boron fiber bundle 1 caused by heat, no problem arose due to poor cooperation between said boron reinforcing fiber bundle 1 and its restraining means, as might possibly have been the case in the above shown first through sixth preferred embodiments of the present invention, which utilized a case such as the stainless steel case 2.

Further, the construction as shown above, wherein the boron reinforcing fiber bundle 1 was supported firmly within the casting mold 5, by the outer sides of the wrapped around carbon binding fiber 18 touching the inner walls 11 of said casting mold 5, was very helpful for ensuring good and secure holding of the boron reinforcing fiber bundle 1 during the casting process, while ensuring that the preheating of said boron reinforcing fiber bundle 1 was not lost to the casting mold 5, as explained above.

This particular eighth preferred embodiment of the present invention is particularly suitable for producing fiber reinforced material in pieces which are generally cylindrical in form, because of the action of the carbon binding fiber 18 in restraining the reinforcing fiber bundle 1 during the casting process, which is essentially well adapted to retaining the fiber bundle 1 in a cylindrical form, and would not be suitable for retaining it in any other form.

As a matter of course, it is preferable to make the binding fiber 18 out of a material which does not dissolve into the matrix metal when the molten matrix metal is poured thereonto, such as carbon.

THE NINTH EMBODIMENT

Figure 21:
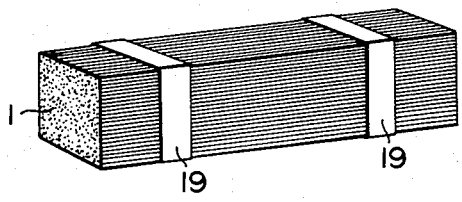
FIG. 21 is a schematic perspective view, showing a cuboid shaped bundle of reinforcing fiber, and two tapes clamped therearound, which are elements involved in the practicing of a ninth preferred embodiment of the method for producing composite material according to the present invention.

FIG. 21 is a schematic perspective view, showing elements involved in the practicing of a ninth preferred embodiment of the present invention. Further, FIG. 19 is applicable, mutatis mutandis, to this ninth preferred embodiment also. The particular meaning of this ninth preferred embodiment is as follows: first, the case 2 of the first through sixth preferred embodiments, described above, is dispensed with, and instead two pieces of stainless steel tape 19 are wrapped around the bundle 1 of reinforcing material so as to form a tied fiber bundle which is preheated and is stood up within the casting mold 5 with a space left between the circumferentially outer parts of the fiber bundle 1 and the sides of the casting mold 5, in order to provide heat insulation therebetween so as to stop the fiber bundle 1 from being cooled down and losing its preheating temperature to the casting mold 5 which is preheated to a much lower temperature; second, the combination of materials of carbon reinforcing fiber and aluminum matrix metal is used. The production of fiber reinforced material, in this ninth preferred embodiment, was carried out as follows.

Two pieces of stainless steel tape 19 were formed of stainless steel of JIS (Japanese Industrial Standard) SUS310S, and were 0.2 mm in diameter and 5 mm wide. These two pieces of stainless steel tape 19 were clamped around a bundle of reinforcing fiber 1, which in this ninth preferred embodiment of the present invention was so called Torayca M40 type high elastic modulus fiber made by Toray Co. Ltd. Said bundle of carbon reinforcing fiber 1 was 80 mm long, and the fibers of said bundle of carbon reinforcing fiber 1 were all aligned with substantially the same fiber orientation and were 7 microns in diameter. This clamping of the two pieces of stainless steel tape 19 was performed at places about 15 mm away from the ends of the bundle of carbon reinforcing fiber 1, i.e. at two places about 50 mm apart from one another, each about 25 mm from the center of the bundle 1. The bundle 1 of carbon reinforcing fiber was squeezed by the two pieces of stainless steel tape 19 by such an amount that its volume ratio was approximately 70%; i.e. so that the proportion of the total volume of the bundle of carbon reinforcing fiber 1 actually occupied by carbon fiber was approximately 70%, the rest of this volume of course at this initial stage being occupied by atmospheric air. Further, in the shown ninth preferred embodiment of the present invention, the orientation of the fibers of the bundle of carbon reinforcing fiber 1 was in the direction along the central axis of the bundle 1, and also the bundle 1 was formed into a roughly cuboid shape, i.e. with a roughly rectangular cross section; and thus the two pieces of stainless steel tape 19 were formed with sharp bends or folds at the corners of said rectangular cross section.

Next, the bundle of carbon reinforcing fiber 1 with the two stainless steel tapes 19 tied therearound was preheated up to a temperature substantially higher than the melting point of the matrix metal which it was intended to use for commingling with said reinforcing fiber 1. In this ninth preferred embodiment of the present invention, in which the intended matrix metal was aluminum metal, the bundle of carbon reinforcing fiber 1 with the stainless steel tapes 19 tied therearound was heated up to 900° C., which was a temperature substantially higher than 660° C., which is the melting point of aluminum metal.

Next, the heated bundle of carbon reinforcing fiber 1 with the two stainless steel tapes 19 tied therearound was placed into a casting mold 5, so that the bundle 1 was supported on one of its ends on the bottom of the casting mold 5, and so that the outer sides of the two wrapped around stainless steel tapes 19 touched the inner walls 11 of said casting mold 5, but so that the outer peripheral part of the carbon fiber bundle 1 did not touch said inner walls 11. In other words, a heat insulating space 10 was left between the outer cuboid surface of said roughly cuboid shaped carbon fiber bundle 1 and the inner walls 11 of said casting mold 5, and the carbon fiber bundle 1 was supported within the casting mold 5 by the pressure of the sides of said two wrapped around stainless steel tapes 19 pressing against the inner walls 11 of said casting mold 5. At this time the casting mold 5 was preheated to a temperature of 300° C., in this ninth preferred embodiment of the present invention. Because this mold preheat temperature of 300° C. was very much lower than the above mentioned stainless steel tape and reinforcing fiber preheat temperature of 900° C., if such a heat insulating space 10 had not been left between the outer cuboid surface of said cuboid bundle of reinforcing fiber 1 and the inner walls 11 of said casting mold 5, the cuboid carbon reinforcing fiber bundle 1 would almost immediately have been cooled down by contact with the casting mold 5, and the practice of the process according to the present invention would have been impossible.

Next, a quantity of molten aluminum 15 at a temperature of approximately 850° C. (substantially above the melting point of aluminum, which is 660° C.) was poured briskly into the casting mold 5, so that the bundle of carbon reinforcing fiber 1 with the two stainless steel tapes 19 tied therearound, said fiber bundle 1 being still at substantially its aforesaid preheat temperature of 900° C. because of the provision of the heat insulating space 10, was submerged below the surface of said quantity of molten aluminum 15 contained in the casting mold 5. The upper free surface of the mass of molten aluminum 15 was then pressurized by a pressure plunger 6, which was forced into an upper part of the casting mold 5 with which said pressure plunger 6 cooperated closely, to a high pressure of approximately 1000 kg/cm$^2$. The pressure plunger 6 was previously preheated to approximately 200° C. The bundle of carbon reinforcing fiber 1 with the stainless steel tapes 19 tied therearound was kept in this submerged condition under the molten aluminum 15 for a certain time, and during this time the molten aluminum 15 was gradually allowed to cool until said aluminum 15 all becomes completely solidified. The aforesaid high pressure of approximately 1000 kg/cm$^2$ was maintained during all this cooling period, until complete solidification of the mass of molten aluminum 15.

Finally, the remnants of solidified aluminum and the two stainless steel tapes 19 were removed by machining or the like from around the bundle of carbon reinforcing fiber 1, which had now become thoroughly infiltrated with the aluminum matrix metal to form a cuboid of composite carbon fiber/aluminum material. If was found, in this ninth preferred embodiment of the present invention described above, that substantially no voids existed between the fibers of this cuboid of composite carbon fiber/aluminum material. It is presumed that the air which was originally present between the fibers of the cuboid bundle 1 of reinforcing carbon fiber was displaced by the flowing of the molten aluminum 15 through the interstices between the fibers of the cuboid 1, both from the ends of the carbon reinforcing fiber bundle 1, and also to a certain limited extent through the sides thereof, which were left exposed to the molten aluminum matrix metal mass 15 by the aforesaid action of the two stainless steel tapes 19 in keeping the sides of said carbon reinforcing fiber bundle 1 away from the inner walls 11 of said casting mold 5.

For this flowing, it is again considered that the preheating of the bundle of carbon reinforcing fiber 1 with the stainless steel tapes 19 tied therearound to a temperature substantially higher than the melting point of the aluminum matrix metal was absolutely essential, because otherwise the flowing aluminum matrix metal would have tended to solidify as it flowed between the carbon fibers of the bundle of carbon reinforcing fiber 1 with the two stainless steel tapes 19 tied therearound, partly due to the high packing density of said carbon reinforcing fiber 1, which as explained above was as high as 70%, and thus the free flowing of the aluminum matrix metal between the carbon fibers would have been prevented, causing bubbles or voids to be formed in the resulting composite material. Such preheating should again be carried out to a temperature substantially higher than the melting point of the aluminum matrix metal, in order properly to fulfil its function.

At this time, the action of the two stainless steel tapes 19 for maintaining the desired shape of the bundle 1 of reinforcing carbon fibers was very important. If no tying means such as the stainless steel tapes 19 had been provided, then the mass of reinforcing carbon fibers 1 would have tended to get out of shape, and also the density and orientation of these carbon reinforcing fibers would have been disturbed, during the pouring of the molten aluminum matrix metal thereonto; and thereby the quality of the resulting carbon fiber-/aluminum composite material formed would have been deteriorated.

Further, it is presumed that the pressure applied to the upper free surface of the mass of molten aluminum 15 by the pressure plunger 6 was important for forcing the molten aluminum matrix metal to flow between the carbon fibers of the reinforcing carbon fiber bundle 1. If no such pressure had been applied, it is not considered that a good composite material would have been produced. The fact that this pressure was high, of an order of 1000 kg/cm$^2$, is also considered to be important.

Thus, according to the method described, the air which was originally present between the fibers of the bundle of carbon reinforcing fiber 1 did not subsequently impede the good contacting together of the molten aluminum matrix metal and of the carbon fibers of the bundle of carbon reinforcing fiber 1. Thus the same functional effect was provided, in this ninth preferred embodiment of the present invention, as was provided by the vacuum used in the prior art methods described above, i.e. it was prevented that atmospheric air trapped between the fibers of the bundle of carbon reinforcing fiber 1 should impede the infiltration of the molten aluminum matrix metal therebetween; and this effect was provided without the need for provision of any vacuum device.

When a tensile strength test was performed upon such a piece of composite carbon fiber/aluminum material made in such a way as described above, according to the ninth preferred embodiment of the present invention, at 0° fiber orientation, a tensile strength of 80 kg/mm$^2$ to 90 kg/mm$^2$ was recorded. This is comparable to the tensile strength of an carbon fiber/aluminum composite material which has been made by either of the above described inefficient conventional methods, ie. the diffusion adhesion method or the autoclave method.

The use of the stainless steel tapes 19 was of course helpful for maintaining the shape of the bundle 1 of reinforcing carbon fiber, and for maintaining the orientation of these carbon fibers during the infiltration process. Further, as explained above, because the heat insulating space 10 was left between the outer cuboid surface of said reinforcing carbon fiber bundle 1 and the inner walls 11 of said casting mold 5, due to the spacing action of said two pieces of stainless steel tape 19, thereby it was prevented that the cuboid carbon reinforcing fiber bundle 1 tied thereby should quickly be cooled down by contact with the casting mold 5, before pouring of the molten aluminum mass 15 thereinto. Thereby, the practice of the process according to the present invention became possible.

A particular advantage of the shown ninth preferred embodiment of the present invention is that, because the two stainless steel tapes 19 were not one solid piece, but were relatively flexible and also were separated from one another, no difficulty arose with relation to the differential expansion of the bundle 1 of reinforcing carbon fibers, and the two stainless steel tapes 19. In other words, as the stainless steel tapes 19 and the reinforcing carbon fiber bundle 1 were heated up and cooled, both together and differentially, no problem arose of differential expansion of the two different materials thereof. Thus, because the restraining means for holding the reinforcing carbon fiber bundle 1 (i.e., the two stainless steel tapes 19), in this ninth preferred embodiment, was able flexibly to follow the expanding and the contracting of said carbon fiber bundle 1 caused by heat, no problem arose due to poor cooperation between said carbon reinforcing fiber bundle 1 and its restraining means, as might possibly have been the case in the above shown first through sixth preferred embodiment of the present invention, which utilized a case such as the stainless steel case 2.

This particular ninth preferred embodiment of the present invention is particularly suitable for producing fiber reinforced material in pieces which are generally cuboid in form, because of the action of the two stainless steel tapes 19 in restraining the reinforcing fiber bundle 1 during the casting process, which is essentially well adapted to retaining the fiber bundle 1 in a cuboid form. Only such a restraining means as the shown stainless steel tapes 19, which can be formed with sharp corners bent therein, is suitable for such cuboid restraint; tying by flexible fibers or wires such as the carbon or stainless steel fibers and wires used in the seventh and eighth preferred embodiments described above would not work for restraining the reinforcing fiber mass in a cuboid shape.

Further, the construction as shown above, wherein the carbon reinforcing fiber bundle 1 was supported firmly within the casting mold 5, by the outer sides of the two wrapped around stainless steel tapes 19 touching the inner walls 11 of said casting mold 5, was very helpful for ensuring good and secure holding of the carbon reinforcing fiber bundle 1 during the casting process, while ensuring both that the preheating of said carbon reinforcing fiber bundle 1 was not lost to the casting mold 5, as explained above, and also that the molten aluminum matrix metal mass 15 could well get at the sides of said carbon reinforcing fiber bundle 1 so as to penetrate into the interstices thereof.

As a matter of course, it was preferable to make the tapes 19 out of a material which did not dissolve into the matrix metal when the molten matrix metal was poured thereonto, such as stainless steel.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For example, different materials for the reinforcing material, and/or for the matrix metal, and different combinations of the shown materials, might be used, and might be particularly good in particular circumstances.

Particularly, various aluminum alloys may be used in place of aluminum, and various magnesium alloys may be used in place of magnesium. Examples of these alloys are: AC4C-F(JIS) or 323 (SAE), having content of: less than 0.2% Cu, 6.5–7.5% Si, 0.2–0.8% Mg, less than 0.3% Zn, less than 0.5% Fe, less than 0.5% Mn, less than 0.2% Ti, and balance Al; AC4D-F(JIS) or 322 (SAE), having content of: 1.0–1.5% Cu, 4.5–5.5% Si, 0.4–0.6% Mg, less than 0.3% Zn, less than 0.6% Fe, less than 0.5% Mn, less than 0.2% Ti, and balance Al; AC-8A-F(JIS) or 321 (SAE), having content of: 0.8–1.3% Cu, 11.0–13.0% Si, 0.7–1.3% Mg, less than 0.1% Zn, less than 0.8% Fe, less than 0.1% Mn, 1.0–2.5% Ni, less than 0.2% Ti, and balance Al; MC2-F(JIS) or AZ91C (SAE), having content of 8.1–9.3% Al, 0.4–1.0% Zn, 0.13–0.5% Mn, less than 0.30% Si, less than 0.10% Cu, less than 0.01% Ni, and balance Mg; MDC1A (JIS) or AZ91A (SAE), having content of 8.3–9.7% Al, 0.35–1.0% Zn, more than 0.15% Mn, less than 0.5% Si, less than 0.10% Cu, less than 0.03% Ni, and balance Mg; and MDC1B (JIS) or AZ91B (SAE), having content of 8.3–9.7% Al, 0.35–1.0% Zn, more than 0.15% Mn, less than 0.5% Si, less than 0.35% Cu, less than 0.03% Ni, and balance Mg.

Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. A method of producing a composite material from reinforcing material and molten matrix metal, said reinforcing material being an assembly of parallely arranged linear fibers, comprising the steps, performed in the specific order, of:

(a) charging linear fibers of substantially the same length as parallelly arranged in a tubular case closed at one axial end thereof to form a bundle of said linear fibers while leaving a substantial empty space in said tubular case adjacent the closed axial end thereof;

(b) heating said bundle of said linear fibers to a temperature substantially above the melting point of said matrix metal;

(c) placing said tubular case with said heated bundle of said linear fibers charged therein in a cavity of a pressurizing type casting mold having a pressure plunger in such a manner that only one of opposite axial ends of said bundle of said linear fibers is directly exposed to the space of said cavity while the other of the opposite axial ends and an annular outer side surface of said bundle of said linear fibers is substantially isolated from the space of said cavity;

(d) pouring said matrix metal in molten condition into said cavity so as to submerge said tubular case with said heated bundle of said linear fibers charged therein totally in a molten bath of said matrix metal received in said cavity with said one axial end of said bundle of said linear fibers directly open to said cavity space being directly exposed to the body of said molten bath of said matrix metal while said other axial end and said annular outer side surface of said bundle of said linear fibers are substantially isolated from direct exposure to the body of said molten bath of said matrix metal;

(e) applying a substantial pressure to said molten bath of said matrix metal by driving said pressure plunger so as to infiltrate said molten matrix metal into spaces left among and around said linear fibers in said tubular case in the axial direction of said bundle of said linear fibers; and (f) cooling said molten bath of said matrix metal with said bundle of said linear fibers submerged therein and infiltrated with said molten matrix metal down to a temperature below the melting point of said matrix metal while maintaining said pressure.

2. A method according to claim 1, wherein said tubular case is made of a metal whose melting point is substantially higher than that of said matrix metal.

3. A method according to claim 1, wherein said tubular case is made of a refractory material, and said heating of said bundle of said linear fibers in step (b) is done by electromagnetic high frequency induction heating.

* * * * *